US011112220B2

(12) United States Patent
Takamura et al.

(10) Patent No.: US 11,112,220 B2
(45) Date of Patent: Sep. 7, 2021

(54) DART GAME APPARATUS

(71) Applicants: Kabushiki Kaisha SEGA Games, Tokyo (JP); Kabushiki Kaisha Dartslive, Tokyo (JP)

(72) Inventors: Hiroshi Takamura, Tokyo (JP); Takayuki Ohnishi, Tokyo (JP)

(73) Assignees: Kabushiki Kaisha SEGA Games, Tokyo (JP); Kabushiki Kaisha Dartslive, Tokyo (JP)

( * ) Notice: Subject to any disclaimer, the term of this patent is extended or adjusted under 35 U.S.C. 154(b) by 0 days.

(21) Appl. No.: 16/631,108

(22) PCT Filed: Jul. 30, 2018

(86) PCT No.: PCT/JP2018/028503
§ 371 (c)(1),
(2) Date: Jan. 14, 2020

(87) PCT Pub. No.: WO2019/026856
PCT Pub. Date: Feb. 7, 2019

(65) Prior Publication Data

US 2020/0132419 A1 Apr. 30, 2020

(30) Foreign Application Priority Data

Jul. 31, 2017 (JP) ..... JP2017-148514

(51) Int. Cl.
*F41J 3/02* (2006.01)
*F41J 3/00* (2006.01)
*F41J 5/02* (2006.01)

(52) U.S. Cl.
CPC ..... *F41J 3/02* (2013.01); *F41J 3/0061* (2013.01); *F41J 5/02* (2013.01)

(58) Field of Classification Search
CPC ..... F41J 3/02; F41J 3/0061; F41J 5/02
USPC ..... 273/373
See application file for complete search history.

(56) References Cited

U.S. PATENT DOCUMENTS 4,789,932 A * 12/1988 Cutler ..... F41J 5/02 700/92
6,717,684 B1 * 4/2004 Fikes ..... F41J 5/02 250/221
2007/0246887 A1 10/2007 Kagami et al.

FOREIGN PATENT DOCUMENTS

| | | |
|---|---|---|
| CN | 106595396 A | 4/2017 |
| JP | 2001-509251 | 7/2001 |
| JP | 4682986 | 2/2011 |
| KR | 10-2010-0034643 A | 4/2010 |
| WO | WO 98/31979 | 7/1998 |

(Continued)

*Primary Examiner* — Eugene L Kim
*Assistant Examiner* — Rayshun K Peng
(74) *Attorney, Agent, or Firm* — Blank Rome LLP

(57) ABSTRACT

[The present invention is] a dart game apparatus that provides a dart game in which one player successively throws n number of (n=3 or 4) darts D at a dart board 12, having: light sources LS that are disposed around the dart board 12 and emit lights L along the board face of the dart board 12; a plurality of photo-sensors S that are disposed around the dart board 12 at approximately the same height from the dart board 12 in the board thickness direction, and detect the brightness of the lights L emitted from the light sources LS; and a processor that calculates a hit position of a dart D in the dart board 12 based on the brightness of each light. A number of photo-sensors S is n×2.

4 Claims, 18 Drawing Sheets

(56) References Cited

FOREIGN PATENT DOCUMENTS

| | | | | |
|---|---|---|---|---|
| WO | WO-9831979 | A1 * | 7/1998 | ..... F41J 5/02 |
| WO | WO 2006/070875 | A1 | 7/2006 | |
| WO | WO 2016/203194 | A1 | 12/2016 | |

* cited by examiner

DART GAME APPARATUS

CROSS REFERENCE TO RELATED APPLICATION

This application is related to Japanese Patent Application No. 2017-148514, filed on Jul. 31, 2017, which is incorporated herein by reference.

TECHNICAL FIELD

The present invention relates to a dart game apparatus.

BACKGROUND ART

A dart game apparatus, where light-emitting sensors and light-receiving sensors are disposed around a dart board, and a position (coordinates) of a dart that hits the dart board is calculated by detecting the interruption of the light emitted from the light-emitting sensors, caused by the dart, is conventionally known (see Patent Document 1).

On the other hand, Patent Document 2 discloses a technique to calculate a position of a dart by triangulation, based on the brightness of the light (shade of the dart) generated by the dart, out of the brightness of the lights detected by photo-sensors. Patent Document 2 also discloses that all positions of three darts can be calculated by using five photo-sensors.

CITATION LIST

Patent Document

Patent Document 1: Japanese Patent No. 4682986

Patent Document 2: Japanese Translation of PCT Application No. 2001-509251

SUMMARY

Technical Problem

For example, FIG. 6 of this application is a diagram depicting an example of calculating each position where three darts hit when five photo-sensors S1 to S5 are disposed on a dart board at equal intervals. However if a dart D1 of the first throw hits a line connecting two photo-sensors S2 and S4, a dart D2 of the second throw hits a line connecting the other two photo-sensors S3 and S5, and a dart D3 of the third throw hits an intersection of these lines, for example, only one photo-sensor S1, out of the five photo-sensors S1 to S5, can detect the shade of the darts. In the case of triangulation, a position of a dart cannot be calculated unless two photo-sensors S can detect the shade of this dart. Therefore, the position of the dart D3 of the third throw cannot be calculated if only one photo-sensor S1 can detect the shade of the dart.

With the foregoing in view, it is an object of the present invention to provide a dart game apparatus that can calculate all positions of the darts.

Solution to Problem

A dart game apparatus according to an aspect of the present invention is a dart game apparatus that provides a dart game in which one player successively throws n number of (n=3 or 4) darts at a dart board, comprising: light sources that are disposed around the dart board and emit lights along the board face of the dart board; a plurality of photo-sensors that are disposed around the dart board at approximately the same height from the dart board in the board thickness direction, and detect brightness of lights emitted from the light sources; and a processor that calculates a hit position of the dart on the dart board based on the brightness of the lights. Here a number of photo-sensors is n×2.

According to the above configuration, when a dart game in which one player successively throws n number of (n=3 or 4) darts is provided, n×2 number of photo-sensors are used, hence the positions of all the n number of darts can be calculated.

Advantageous Effects of Invention

According to the present invention, the positions of all the darts can be calculated.

BRIEF DESCRIPTION OF DRAWINGS

FIG. 9A is an example of a graph depicting the brightness of light detected by the photo-sensor S when the dart D of the first throw hit, FIG. 9B is an example of a graph depicting the brightness of light detected by the photo-sensor S when the dart D of the second throw hit after the dart of the first throw hit, and FIG. 9C is an example of a graph depicting the brightness of light when the photo-sensor S performs difference processing of the brightness of light after the dart D of the second throw hits.

DESCRIPTION OF EMBODIMENTS

Embodiments of the present invention will be described with reference to the accompanying drawings. In each drawing, a same or similar composing element is denoted with a same reference sign.

Embodiment 1

General Configuration

Figure 1:
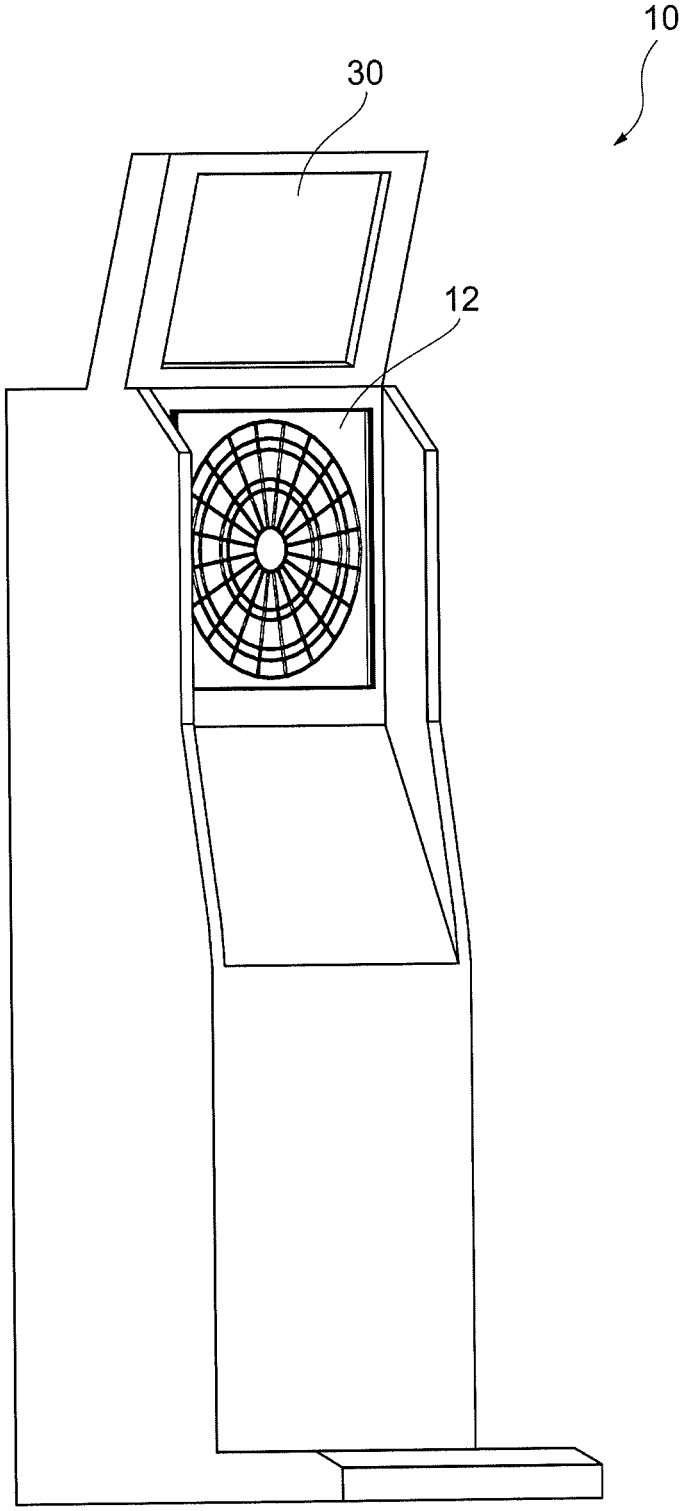
FIG. 1 is an external perspective view of the dart game apparatus 10 according to Embodiment 1 of the present invention.

FIG. 1 is an external perspective view of a dart game apparatus 10 according to Embodiment 1 of the present invention.

As illustrated in FIG. 1, the dart game apparatus 10 is formed in a vertical rectangular parallelepiped, for example. This dart game apparatus 10 provides a player with a dart game in which one player successively throws n number of darts in one round, for example. The dart game may include a plurality of game modes in which a number of darts that one player successively throws is different in accordance with the rules. In this case, the above mentioned "n" is a maximum number of darts that one player successively throws in each game mode. The dart type is not especially limited, and may be a soft tip dart, a hard tip dart or the like, but in Embodiment 1, a case of using soft tip darts will be described.

The dart game apparatus 10 includes a dart board 12 and a display device 30. The dart board 12 is disposed on the front face of the dart game apparatus 10 approximately at a line of sight position when the player is standing. The display device 30 displays a still image or a moving image.

Further, a coin slot, a mode selecting switch and the like (not illustrated) are disposed on the front face of the dart game apparatus 10. The player inserts coins into the coin slot for game payment, presses a mode selecting switch to select a game mode, and plays a dart game. In this dart game, the player stands at a predetermined position facing the dart game apparatus 10, and throws a dart at a predetermined target on the dart board 12. The tip of the dart that reaches the dart board 12 hits the dart board 12, the coordinates of the hit position of the dart (hereafter simply called "position") is detected, and the score based on the hit position is displayed on the display device 30.

Figure 2:
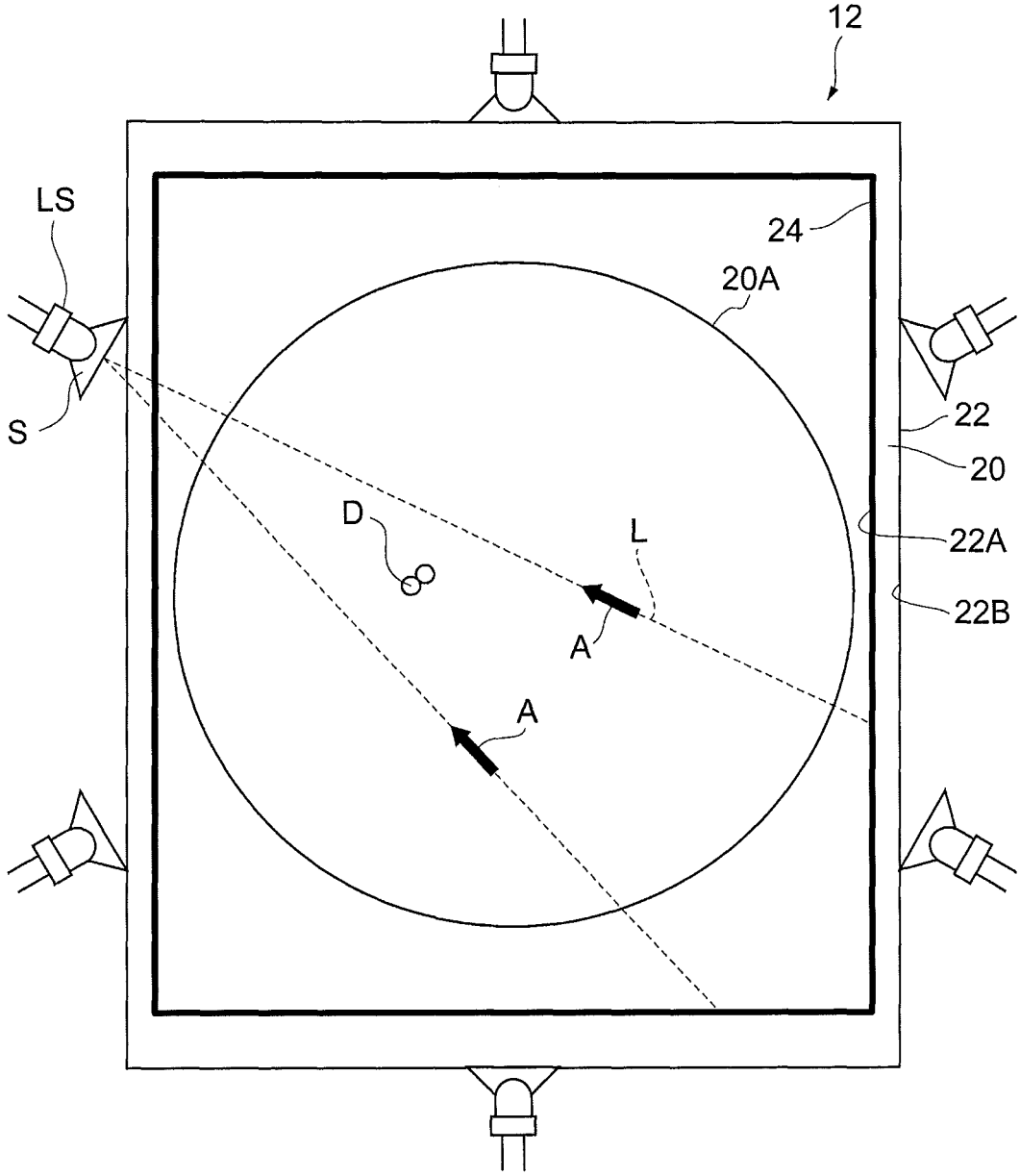
FIG. 2 is a front view of a dart board 12.

FIG. 2 is a front view of the dart board 12.

The dart board 12 includes a plurality of light sources LS, a plurality of photo-sensors S, a board main body 20 and a frame 22.

The plurality of light sources LS are installed in the frame 22 respectively at equal intervals, for example. The plurality of light sources LS are disposed around the dart board 12, approximately at the same height in the board thickness direction from a board face 20A of the dart board 12. A number of lights sources LS is the same as a number of the photo-sensors S. Each light source LS emits light L in the inward direction from the frame 22.

A plurality of photo-sensors S are installed in the frame 22 respectively at equal intervals, for example. Each of the plurality of photo-sensors S and each of the plurality of light sources LS form a pair, and the photo-sensor S and the light source LS forming a pair are disposed adjacent to each other in the board thickness direction. Each photo-sensor S receives light L emitted from a light source LS and converts the received light L into an electric signal, whereby the brightness of the light L is detected from a plurality of angles. The number of photo-sensors S is derived from a later mentioned theoretical formula.

The board main body 20 is formed by a board of which front view is square, for example. On the surface of the board face 20A, a plurality of holes (not illustrated) are formed, so that a dart D hits and engages with the board.

The frame 22 surrounds and holds the board main body 20. The frame 22 extends from the board face 20A in the board thickness direction of the board main body 20, so as to form an inner wall 22A and an outer wall 22B. Thereby one side of the inner wall 22A of the frame 22 faces another side of the inner wall 22A. An opening (not illustrated) is formed in each portion of the inner wall 22A facing the light source LS, so that the light L can transmit through the frame 22.

On the inner wall 22A, a retro-reflector 24 is disposed along the circumferential direction of the board main body 20. The retro-reflector 24 has a function so that when the reflective surface thereof receives the incident light L from the light source LS, this light L is reflected back in the direction toward the light source LS (e.g. direction A in FIG. 2). In other words, the retro-reflector 24 has a function to reflect incident light, so that the intensity of the reflected light becomes strongest in the incident direction of the light. For the retro-reflector 24, a glass beads reflector, a micro-prism reflector or the like is used.

Hardware

Figure 3:
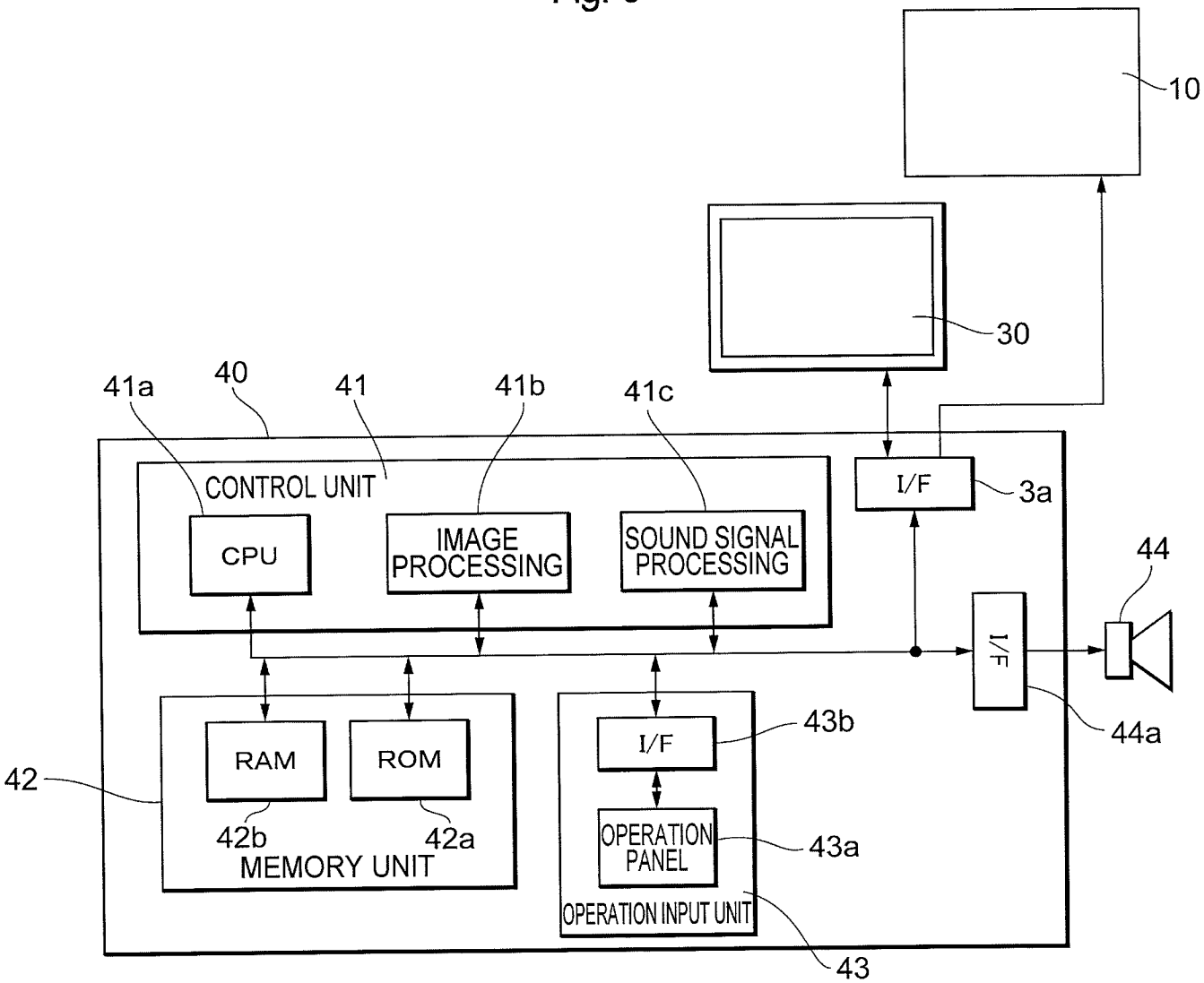
FIG. 3 is a block diagram of hardware of the dart game apparatus 10.

FIG. 3 is a block diagram of hardware of the dart game apparatus 10.

As illustrated in FIG. 3, the dart game apparatus 10 includes a control circuit 40. The control circuit 40 is constituted of a control unit 41, a memory unit 42 and an operation input unit 43. The control unit 41 includes a CPU 41*a* that controls the entire system, an image processor 41*b* that performs image processing (e.g. processing of display position and size) of the image to be displayed on the screen, and a sound signal processing processor 41*c* that generates sound.

The memory unit 42 is constituted of a ROM 42*a* in which programs and data used for the control unit 41 are stored, and a RAM 42*b* that temporarily stores various data in mid-game. In the operation input unit 43, an operation panel 43*a*, where various operation signals of a coin switch to detect the game payment, a select switch to select a game mode, a start switch and the like are inputted, is connected to the control unit 41 and the memory unit 42 via an interface 43*b*.

When the power is turned ON, the CPU 41*a* reads a game program according to a boot program in the ROM 42*a*, and causes the image processor 41*b* and the sound signal processing processor 41*c* to read and process the image and sound data stored in the ROM 42*a*, and outputs the image signals and sound signals to the display device 30 and an acoustic device 44 via the interfaces 3*a* and 44*a* respectively.

The CPU 41*a* controls the progress of the dirt game according to the game program read from the ROM 42*a*, and progresses the game in the game mode desired by the player based on a coin entry signal from the operation input unit 43 and the input signals from the select switch and start switch.

The player plays a game by throwing a dart D aiming at a target on the dart board 12 from a position that is distant from the dart game apparatus 10 by a predetermined distance, so that the dart D hits the board face 20A of the dart board 12. When the dart D, which the player threw aiming at the target on the board face 20A, hits the board face 20A, the dart D interrupts the light L, thereby the brightness of the light L directed to the photo-sensors S changes, and at least two photo-sensors S detect the change in the brightness of the light. These detection signals are sent to the control unit 41, and based on the brightness of the lights detected by the two photo-sensors S, and the CPU 41*a* specifies the brightness of the light caused by the dart D ("peak" or "shade of dart D"), specifies the direction of the shade of the dart D as angles $\alpha$ and $\beta$, for example, and calculates the hit position of the dart D by triangulation using the angles $\alpha$ and $\beta$.

Then the CPU 41*a* reads a score, which corresponds to the calculated position, from a table stored in the ROM 42*a*, and causes the image processor 41*b* to display the change in the image of the target and the score on the display device 30, and also causes the sound signal processing processor 41*c* to generate a sound indicating a score increase, and outputs the sound from the acoustic device 44. Thus, using the detection signals received from the photo-sensors S, the control circuit 40 calculates the hit position, adds up the score, and outputs the sound.

The hit position of a dart D, score information, number of darts D that hit, a number of rounds and the like are sequentially stored in the RAM 42*b*, and the game progresses while outputting images and sounds based on this data. Based on the arithmetic operation result of the program, the image processor 41*b* writes the image data to the RAM 42*b*. The written image data is sent to the display device 30 via the interface (I/F) circuit 3*a*. Further, the sound data that is outputted from the sound signal processing processor 41*c* is also sent to the acoustic device 44 via the interface (I/F) circuit 44*a*.

Logical Formula of Number of Photo-Sensors S

A logical formula to determine a number of photo-sensors S, which can calculate each position of all n number of darts D that hit the board face 20A of the dart board 12, will be described. In the dart game, one player normally throws three darts D sequentially, collects the darts D after all three darts are thrown, then another player takes their turn. In some cases, four or more (especially four) darts D may be thrown (e.g. in the case of determining the turn of the players to throw darts). In other words, the above mentioned "n" is 3 or more ($n \geq 3$). In the following, a case where one player throws three darts D successively will be described.

To calculate the position of a dart D by triangulation, the shade thereof must be detected by two photo-sensors S. Based on this premise, it will be described whether the positions of all the darts D can be calculated or not in the case when a number of photo-sensors S, disposed on the dart board 12, is 2, 3, 4, 5 or 6.

In the Case of Two Photo-Sensors S

A case of calculating each hit position of three darts D, when two photo-sensors S are disposed on the dart board 12 at equal intervals, will be described.

If a dart D of the second throw hits a line connecting a photo-sensor S and a dart D of the first throw in the above-mentioned case, the shade of the dart D of the second throw, which overlaps with the dart D of the first throw, cannot be detected by the photo-sensors S.

As described above, in the case of two photo-sensors S, only the position of the dart D of the first throw can be calculated by triangulation. Therefore each position of all the darts D cannot be calculated if the two photo-sensors S are used.

In the Case of Three Photo-Sensors S

Figure 4:
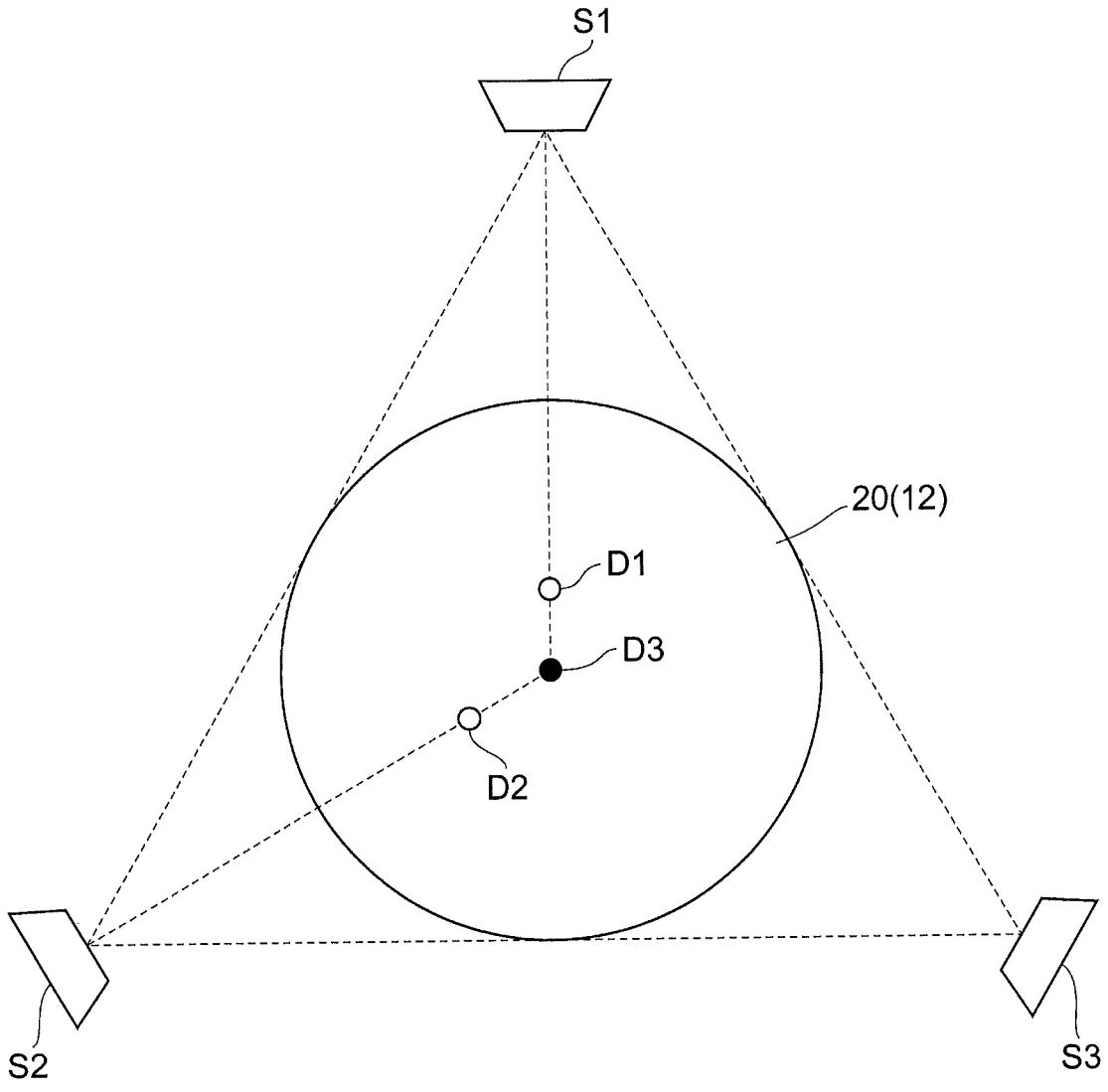
FIG. 4 is a diagram depicting a case of calculating each position in which three darts D (D1, D2, D3) hit when three photo-sensors S (S1, S2, S3) are disposed on the dart board 12 at equal intervals.

FIG. 4 is a diagram depicting a case of calculating each hit position of three darts D (D1, D2, D3) when three photo-sensors S (S1, S2, S3) are disposed on the dart board 12 at equal intervals.

As illustrated in FIG. 4, if the dart D3 of the third throw hit an intersection between a line connecting the photo-sensor S1 and the dart D1 of the first throw, and a line connecting the photo-sensor S2 and the dart D2 of the second throw, the shade of the dart D3, which overlaps with the shade of the dart D1 and the shade of the dart D2, cannot be detected by the photo-sensor S1 and the photo-sensor S2, but can be detected only by the photo-sensor S3. As a consequence, the position of the dart D3 cannot be calculated by triangulation.

Further, if the dart D1 of the first throw and the dart D2 of the second throw hit the line connecting the photo-sensor S1 and the photo-sensor S2 respectively, for example, unlike the positions of the darts D illustrated in FIG. 4, the shade of the dart D2 of the second throw can be detected only by the photo-sensor S3. As a consequence, the position of the dart D2 cannot be calculated by triangulation.

As described above, in the case illustrated in FIG. 4, only the position of the dart D1 of the first throw can be calculated by triangulation. Therefore each position of all the darts D cannot be calculated if the three photo-sensors S are used.

In the Case of Four Photo-Sensors S

Figure 5:
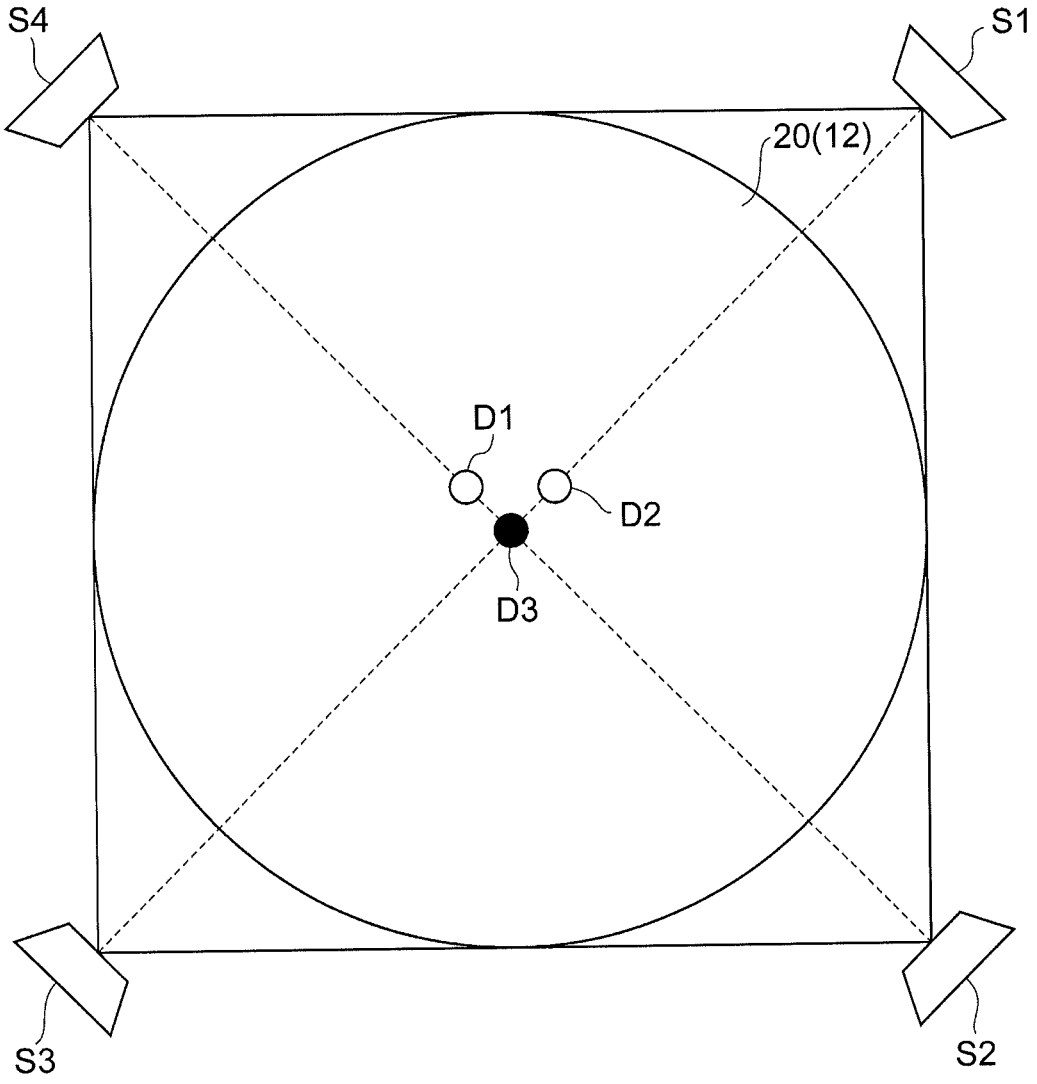
FIG. 5 is a diagram depicting a case of calculating each position in which three darts D (D1, D2, D3) hit when four photo-sensors S (S1, S2, S3, S4) are disposed on the dart board 12 at equal intervals.

FIG. 5 is a diagram depicting a case of calculating each hit position of three darts D (D1, D2, D3) when four photo-sensors S (S1, S2, S3, S4) are disposed on the dart board 12 at equal intervals.

As illustrated in FIG. 5, if the dart D1 of the first throw hits the line connecting the photo-sensors S2 and S4, the dart D2 of the second throw hits the line connecting the photo-sensors S1 and S3, and the dart D3 of the third throw hits the intersection of the above two lines, the shade of the dart D3 of the third throw, which overlaps with the shades of the dart D1 and the dart D2, cannot be detected by any one of the photo-sensors S1 to S4. As a consequence, the positions of the darts D cannot be calculated by triangulation.

As described above, in the case illustrated in FIG. 5, only the positions of the dart D1 of the first throw and the dart D2 of the second throw can be detected by triangulation. Therefore each position of all the darts D cannot be calculated if the four photo-sensors S are used.

In the Case of Five Photo-Sensors S

Figure 6:
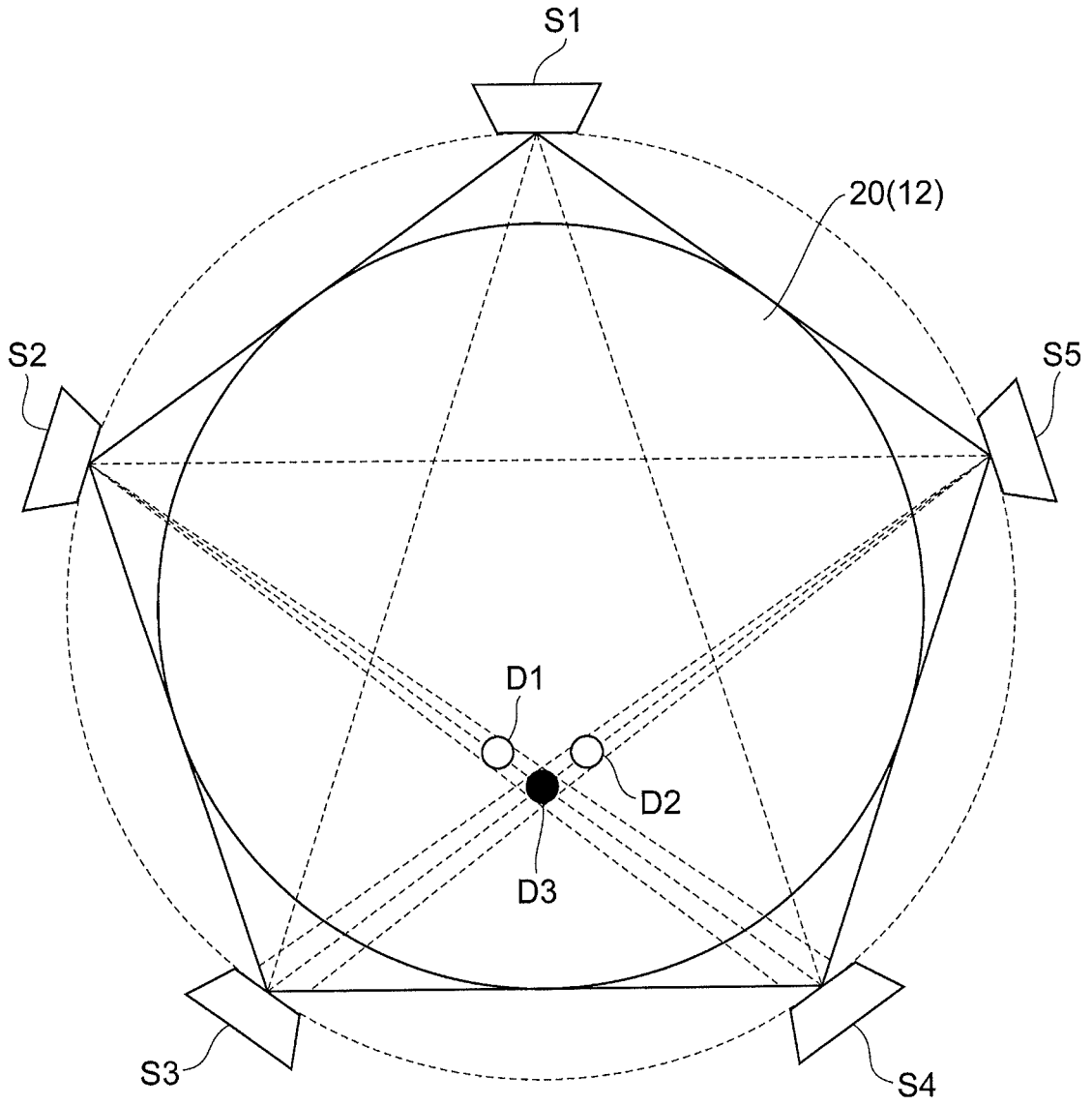
FIG. 6 is a diagram depicting a case of calculating each position in which three darts D (D1, D2, D3) hit when five photo-sensors S (S1, S2, S3, S4, S5) are disposed on the dart board 12 at equal intervals.

FIG. 6 is a diagram depicting a case of calculating each hit position of three dots D (D1, D2, D3) when five photo-sensors S (S1, S2, S3, S4, S5) are disposed on the dart board 12 at equal intervals.

As illustrated in FIG. 6, if the dart D1 of the first throw hits the line connecting the photo-sensors S2 and S4, the dart D2 of the second throw hits the line connecting the photo-sensors S3 and S5, and the dart D3 of the third throw hits the intersection of the above two lines, the shade of the dart D3 of the third throw, which overlaps with the shades of the dart D1 and the dart D2, cannot be detected by the photo-sensors S2, S3, S4 and S5, but can be detected only by the photo-sensor S1. If only the photo-sensor S1 can detect the shade of the dart D3 of the third throw, it can be estimated that the position of the dart D3 of the third throw is in a region near the intersection of the line connecting S2 and S4 and the line connecting S3 and S5, but the precise position in the region cannot be recognized. As described above, in the case illustrated in FIG. 6, only the positions of the dart D1 of the first throw and the dart D2 of the second throw can be calculated by triangulation. Therefore each position of all the darts D cannot be calculated if the five photo-sensors S are used.

In the Case of Six Photo-Sensors S

Figure 7:
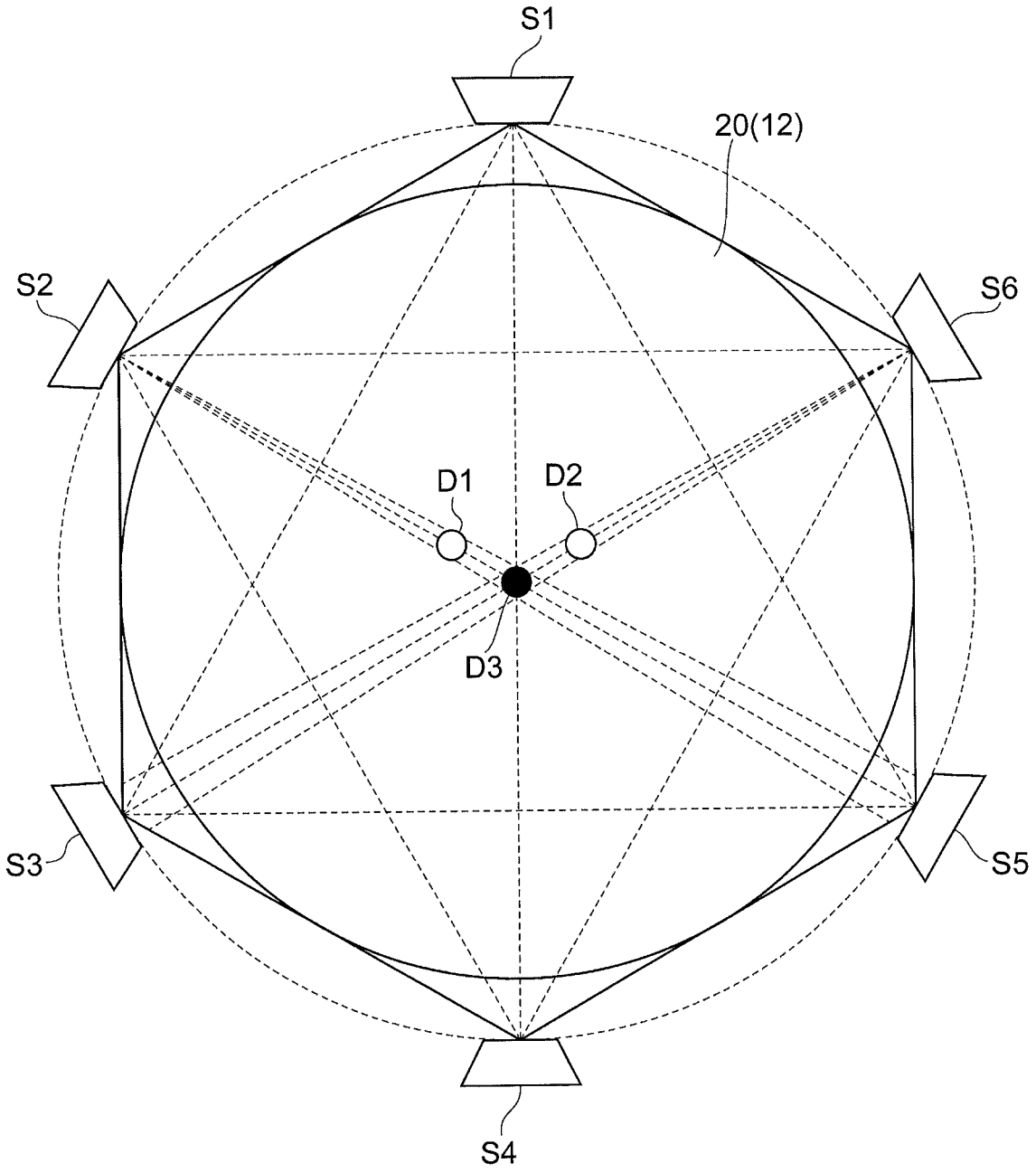
FIG. 7 is a diagram depicting a case of calculating each position in which three darts D (D1, D2, D3) hit when six photo-sensors S (S1, S2, S3, S4, S5, S6) are disposed on the dart board 12 at equal intervals.

FIG. 7 is a diagram depicting a case of calculating each hit position of three darts D (D1, D2, D3) when six photo-sensors S (S1, S2, S3, S4, S5, S6) are disposed on the dart board 12 at equal intervals.

As illustrated in FIG. 7, if the dart D1 of the first throw hits the line connecting the photo-sensors S2 and S5, the dart D2 of the second throw hits the line connecting the photo-sensors S3 and S6, and the dart D3 of the third throw hits the intersection of the above two lines, the shade of the dart D3 of the third throw can be detected by the two photo-sensors S1 and S4.

As described above, in the case illustrated in FIG. 7, the positions of the darts D1 to D3 can be calculated by triangulation. Therefore each position of all the darts D can be calculated if the six photo-sensors S are used.

Conclusion

In conclusion, if the dart D1 of the first throw hits the line connecting two photo-sensors S and the dart D2 of the second throw hits the same line, the shade of the dart D2, which overlaps with the shade of the dart D1 of the first throw (hidden by shade), cannot be detected by these two photo-sensors S at both ends of this line. In other words, in this case, the dart D of the first throw makes it impossible for two photo-sensors S to accurately detect the shade of the dart D of a subsequent throw. In order to calculate the position of one dart D, two photo-sensors S are required, that is, in order to detect the dart of the second throw without fail after the dart of the first throw hits a line connecting two photo-sensors S, four photo-sensors S are required. Further, in order to detect the dart of the third throw without fail after the dart of the second throw hits the line connecting the photo-sensors S, six photo-sensors S are required.

If n number of darts D which are successively thrown is four, and the three darts D thereof hit lines connecting mutually different photo-sensors S at points close to each other, two more photo-sensors S are required to detect the dart of the fourth throw without fail, in addition to the six photo-sensors S. This means that a total of eight photo-sensors S are required (not illustrated).

In other words, in order to calculate each position of n number of darts D when one player successively throws n number of darts D in one round of a dart game, a number of required photo-sensors S is determined by the theoretical formula $2\times n$ ($1\leq n$).

However, if an n number of darts D which are successively thrown is five, the shade of the dart D of the fifth throw may not be detected in some cases, even if the number of photo-sensors S is increased. Such a case will be described with reference to FIG. 8.

Figure 8:
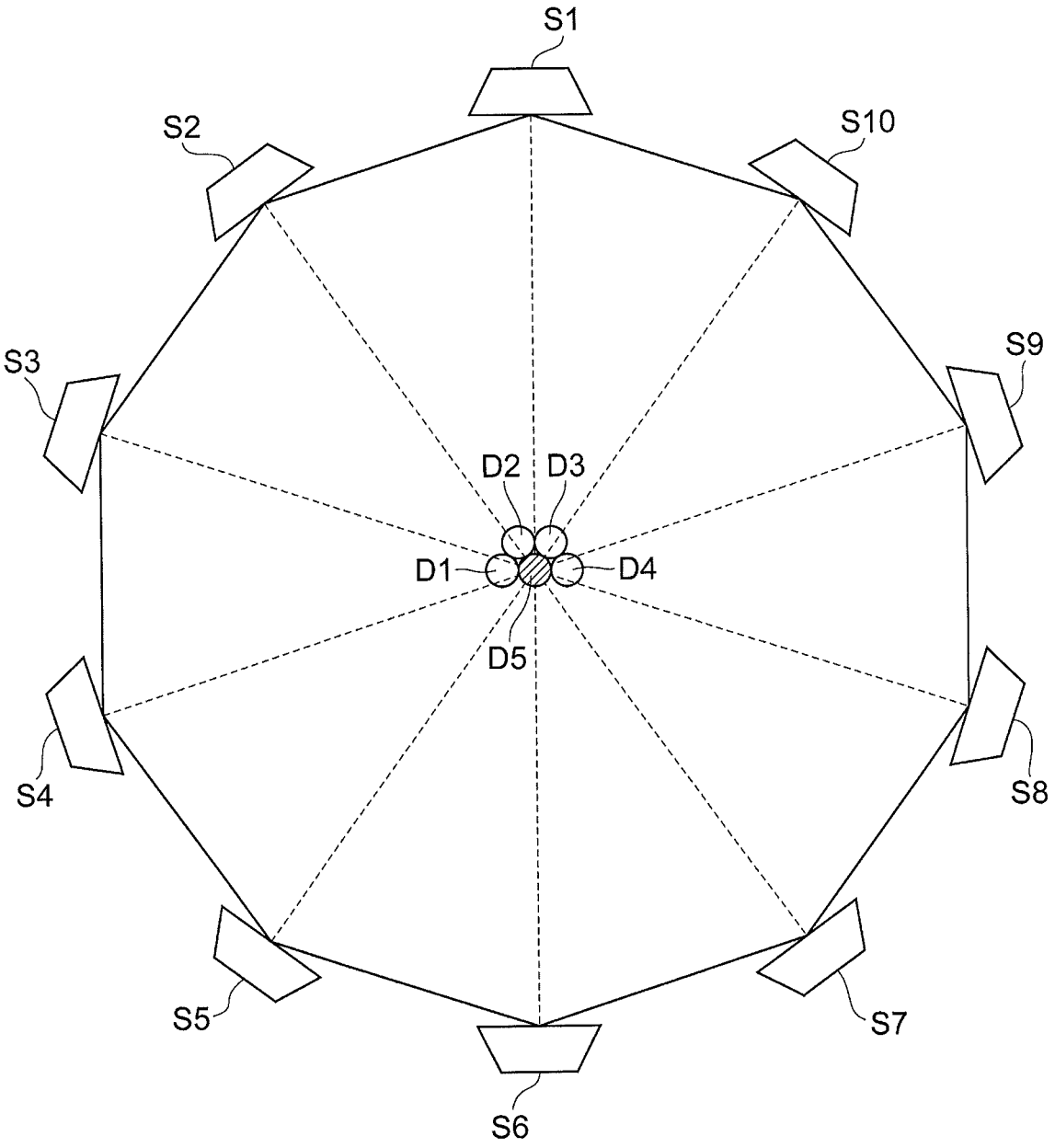
FIG. 8 is a diagram depicting a case of calculating each position in which five darts D (D1 to D5) hit when 10 photo-sensors S (S1 to S10) are disposed on the dart board 12 at equal intervals.

FIG. 8 is a diagram depicting a case of calculating each hit position of five darts D (D1 to D5) when the ten photo-sensors S (S1 to S10) are disposed on the dart board 12 at equal intervals.

As illustrated in FIG. 8, if the dart D5 of the fifth throw hits the center of the area surrounded by the four darts D1 to D4, the shade of the dart D5, which overlaps with a shade of any one of the darts D1 to D4 (hidden by shade), cannot be detected by any of the photo-sensors S1 to S10. Likewise, even if the number of photo-sensors S is increased to twenty, for example, the shade of the dart D5 overlaps with a shade of any one of the darts D1 to D4 (hidden by shade), and cannot be detected by any of the photo-sensors S. Therefore, if an n number of darts D to be thrown is five, the shade of the dart D of the fifth throw may not be detected in some cases, even if the number of photo-sensors S is increased, that is, a number of darts D of which positions can be detected and calculated is four at the maximum ($n\leq 4$).

In Embodiment 1, a dart game in which each player throws one or two darts in one round is not assumed, therefore an n number of darts D that are successively thrown in one round is three or four, and a number of photo-sensors S is six or eight, based on the theoretical formula $2\times n$.

Change of Brightness of Light

Figure 9A:
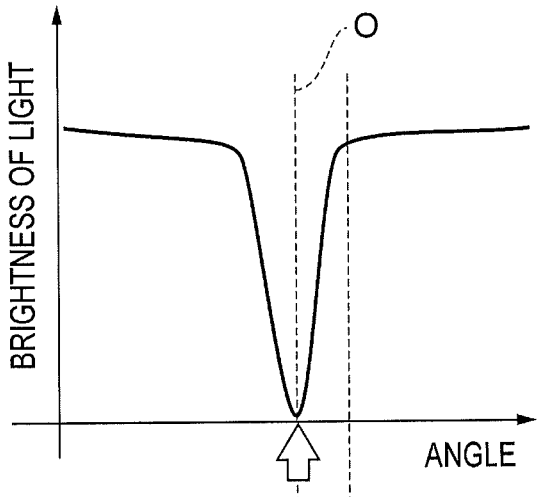
FIG. 9A to FIG. 9C are graphs depicting a change in brightness of the light detected by the photo-sensor S, where
Figure 9B:
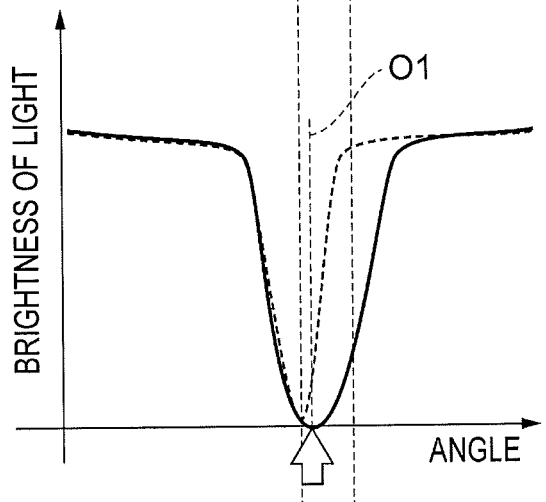
Figure 9C:
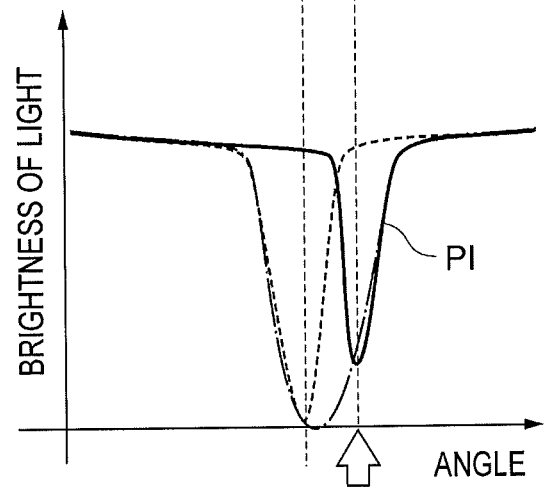

FIG. 9A to FIG. 9C are graphs depicting a change in the brightness of the light detected by a photo-sensor S, where FIG. 9A is an example of a graph depicting the brightness of light detected by the photo-sensor S when the dart D of the first throw hits, FIG. 9B is an example of a graph depicting the brightness of light detected by the photo-sensor S when the dart D of the second throw successively hits after the first throw, and FIG. 9C is an example of a graph depicting the brightness of light when the photo-sensor S performed the difference processing of the brightness of light after the dart D of the second throw hits. The photo-sensor S is constituted of a plurality of image pickup elements to implement a required resolution, and each image pickup element performs photoelectric conversion from the brightness of the light into a charge amount, sequentially reads the charge amount, and converts the charge amount into an electric signal. When a dart D hits the dart board, the light L is interrupted at that portion, and a shade is generated, which causes a change in the electric signal. The electric signal corresponds to the brightness of the light, that is, the intensity of the light L. In the graphs of the brightness of light in FIGS. 9A to 9C, the ordinate indicates the brightness of the light L measured by the photo-sensor S, and the abscissa indicates the position (angle) of the image pickup element that is sequentially read by the photo-sensor S, whereby the angle of the generated shade viewed from the photo-sensor S is known.

As illustrated in FIG. 9A, if the dart D of the first throw hits, the brightness of the light detected by the photo-sensor S includes a peak at which the brightness of the light drops. This peak indicates the shade of the dart D. The position of the dart D is calculated by triangulation based on the angle indicated by the arrow in FIG. 9A, at which the center line O of the width of the peak is located.

Here it is assumed that the dart D of the second throw hits right next to the dart D of the first throw, as illustrated in FIG. 2. In this case, the peak of the dart D of the second throw overlaps with the peak of the dart D of the first throw, and only one wide peak is detected, as illustrated in FIG. 9B. If the angle indicated by the arrow in FIG. 9B, at which the center line O1 of the width of the peak is located, is regarded as the angle of the dart D of the second throw, and the position of the dart D of the second throw is calculated based on this angle, an error is generated between the calculated position and the actual position of the dart D of the second throw.

In Embodiment 1, when a dart D hits the dart board 12, the CPU 41*a* stores the brightness of the light detected by the photo-sensor S in the RAM 42*b* as reference. Then if the next dart D hits the dart board 12 as indicated in FIG. 9C, the CPU 41*a* calculates the difference between this brightness of the light detected by the photo-sensor S and the stored brightness of the light. This difference is a peak (shade) of only the next dart D, hence the CPU 41*a* regards the angle indicated by the arrow in FIG. 9C, at which the center line of the width of this peak is located, as the angle of the dart D of the second throw, and calculates the hit position of the dart D of the second throw based on this angle. Thereby the generation of error between the calculated position and the actual position of the dart D of the second throw can be prevented.

Processing Based on Game Program

Figure 10:
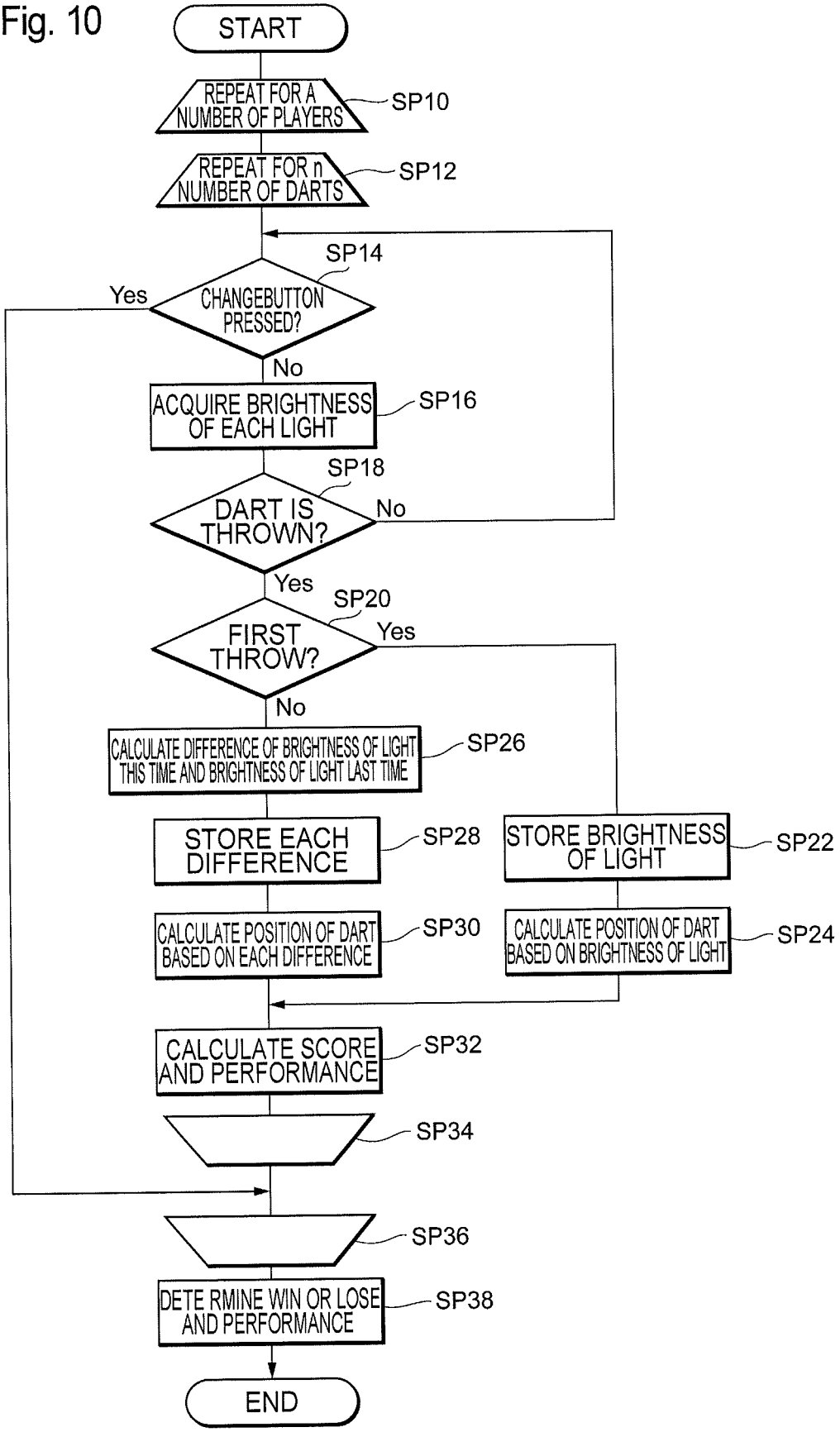
FIG. 10 is a flow chart depicting the processing flow of the CPU 41*a* based on a game program in the dart game apparatus 10 of Embodiment 1 of the present invention.

FIG. 10 is a flow chart depicting a processing flow of the CPU 41*a* based on the game program that is executed by the dart game apparatus 10 according to Embodiment 1 of the present invention.

Step SP10

The CPU 41*a* repeats the processing in step SP12 to step SP34 for a number of players that will play the dart game.

Step SP12

If the dart game provided by the dart game apparatus 10 is a game of throwing n number of darts D in one round, CPU 41*a* repeats the processing in step SP14 to step SP32 for n number of darts. In the game, n is 3, and when the turn of players is determined before starting a game, n is a number of players.

Step SP14

Based on the presence of a change button pressing signal (not illustrated), the CPU 41*a* determines whether the change button was pressed. The CPU 41*a* advances to the processing in step SP36 if the result is Yes, or to step SP16 if No.

Step SP16

The CPU 41*a* acquires a respective detection signal from six photo-sensors S, that is, the brightness of the light detected by each photo-sensor S. Then the CPU 41*a* advances to the processing in step SP18.

Step SP18

The CPU 41*a* determines whether a dart D was thrown based on the brightness of light of each photo-sensor S. In concrete terms, the CPU 41*a* determines whether brightness changed in at least two lights, out of the lights of each photo-sensor S, and determines that the dart D was thrown (Yes) if the brightness changed in the at least two lights, or determines that the dart D was not thrown (No) if the brightness did not change in the at least two lights. If Yes, the CPU 41*a* increases the total number of darts D that were thrown and advances to the processing in step SP20, and if No, the CPU 41*a* returns to the processing in step SP14.

Step SP20

The CPU 41*a* determines whether the dart D is the dart of the first throw by a player. The CPU 41*a* advances to the processing in step SP22 if Yes, or to the processing in step SP26 if No.

Step SP22

The CPU 41*a* digitizes the brightness of each light and stores the brightness in the RAM 42*b*. Then the CPU 41*a* advances to the processing in step SP24.

Step SP24

The CPU 41*a* calculates the position of the dart D by triangulation, based on the brightness of each light, particularly based on the brightness of the light generated by the dart D (shade of the dart D) out of the brightness of at least two lights that changed. Then the CPU 41*a* advances to the processing in step SP32.

Step SP26

The CPU 41*a* calculates the difference between the brightness of each light detected by the photo-sensors S this time (brightness of light this time) and the brightness of each light detected by the photo-sensors S the last time (brightness of light last time) respectively, as indicated in FIG. 9C, for example. Then the CPU 41*a* advances to the processing in step SP28.

Step SP28

The CPU 41*a* stores each difference in the RAM 42*b*. Then the CPU 41*a* advances to the processing in step SP30.

Step SP30

The CPU 41*a* calculates the position of the dart D by triangulation based on each difference, particularly based on the difference of the brightness of the light caused by the dart D out of the brightness of at least two lights that changed. Then the CPU 41*a* advances to the processing in step SP32.

Step SP32

The CPU 41*a* calculates the score based on the calculated position of the dart D and stores it in the RAM 42*b* in association with the player, whereby the player is provided with their score. The CPU 41*a* also makes a performance of the scoring based on the calculated score, such as reproducing an image on the display device 30 or outputting a sound from the acoustic device 44. Then the CPU 41*a* advances to the processing in step SP34.

Step SP34

The CPU 41*a* returns to the processing in step SP12 until the processing in step SP14 to step SP32 are repeatedly performed for all the n number of darts D respectively, and advances to the processing in step SP36 when the repeat of the processing ends.

Step SP36

The CPU 41*a* returns to the processing in step SP10 until the processing in step SP12 to step SP34 are repeatedly performed for a number of players, and advances to the processing in SP38 when the repeat of the processing end.

Step SP38

The CPU 41*a* calculates the total score for each player, and determines the winner and the loser among the players based on each calculated total score. Further, based on the determination of the winner/loser, the CPU 41*a* makes a performance of the determination, such as reproducing an image on the display device 30 or outputting a sound from the acoustic device 44.

As described above, according to Embodiment 1, n×2 (n=3 or 4) number of photo-sensors S are used when a dart game, in which n number of darts D are thrown in one round, is provided, hence all positions of the n number of darts D can be calculated.

Further, according to Embodiment 1, the retro-reflector 24 is also provided, hence the light L emitted by the light source LS can be reflected back toward the light source LS, and the reflected light can be utilized to detect the shade of the dart D. Since the retro-reflector 24 functions like a light source LS as just described, a number of light sources LS can be kept to a minimum. If the number of light sources LS can be kept to a minimum, the manufacturing cost of the dart game apparatus 10 can be kept to a minimum as well.

Furthermore, according to Embodiment 1, the hit position of the dart D is calculated based on the difference of the brightness of the light this time and the brightness of the light last time, hence even if two darts D hit positions close to each other, as illustrated in FIG. 2, the positions of the darts D can be accurately calculated.

Embodiment 2

A dart game apparatus according to Embodiment 2 of the present invention will be described next. Embodiment 2 is different from Embodiment 1 in terms of the position calculation processing of the CPU 41*a*, such as calculating an inclination of a dart D with respect to the dart board 12, and calculating the hit position of the dart D based on the determined inclination. The configuration of the dart game apparatus according to Embodiment 2 is the same as the dart game apparatus 10 according to Embodiment 1, except for the configuration of the retro-reflector 24 to calculate the inclination and the configuration of the photo-sensors S.

Figure 11:
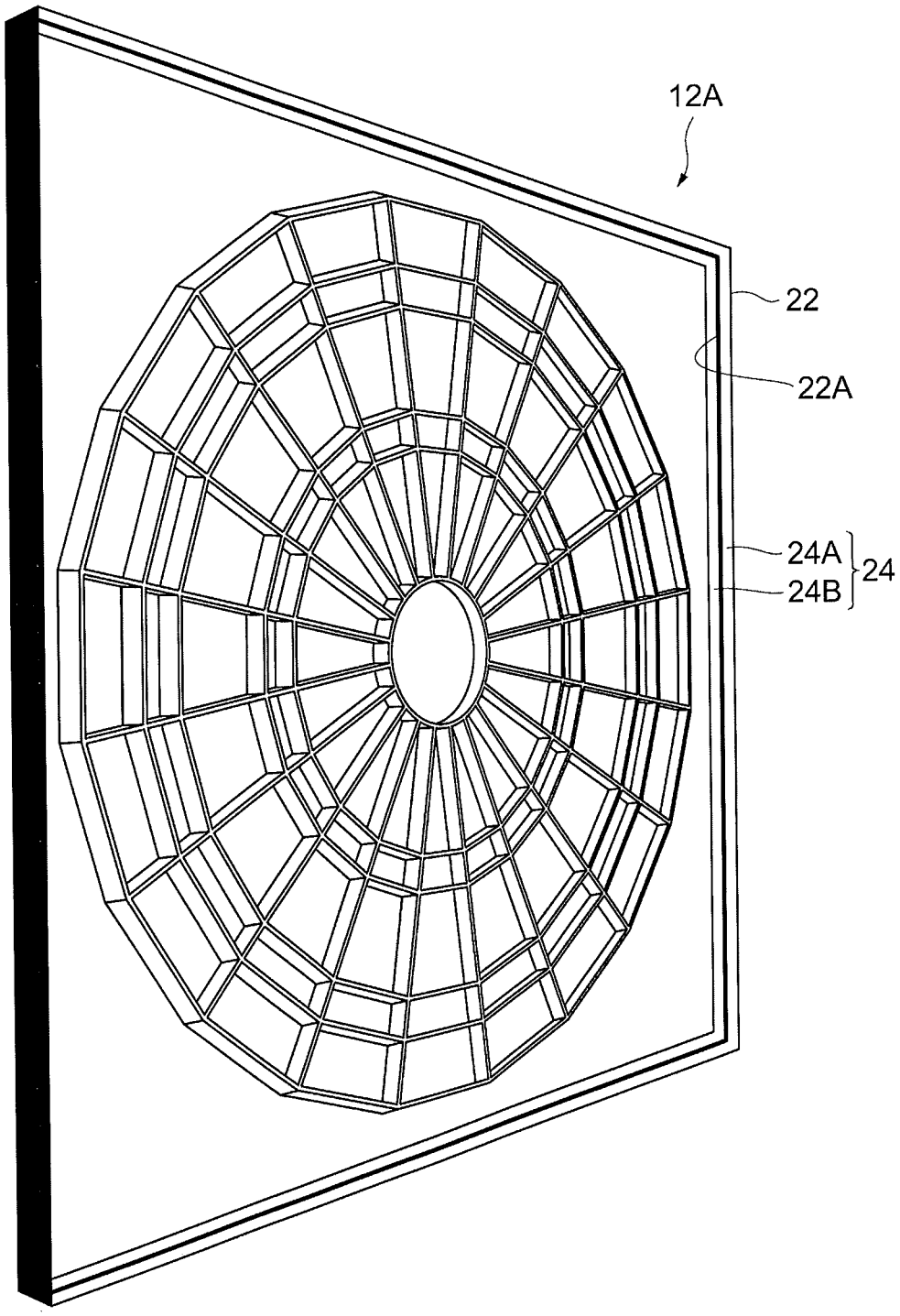
FIG. 11 is a perspective view of the dart board 12A included in a dart game apparatus according to Embodiment 2.

FIG. 11 is a perspective view of the dart board 12A of the dart game apparatus according to Embodiment 2.

As illustrated in FIG. 11, the dart board 12A includes the retro-reflector 24. The retro-reflector 24 includes two reflectors 24A and 24B, which are disposed next to each other with a space in the board thickness direction of the dart board 12A.

Figure 12:
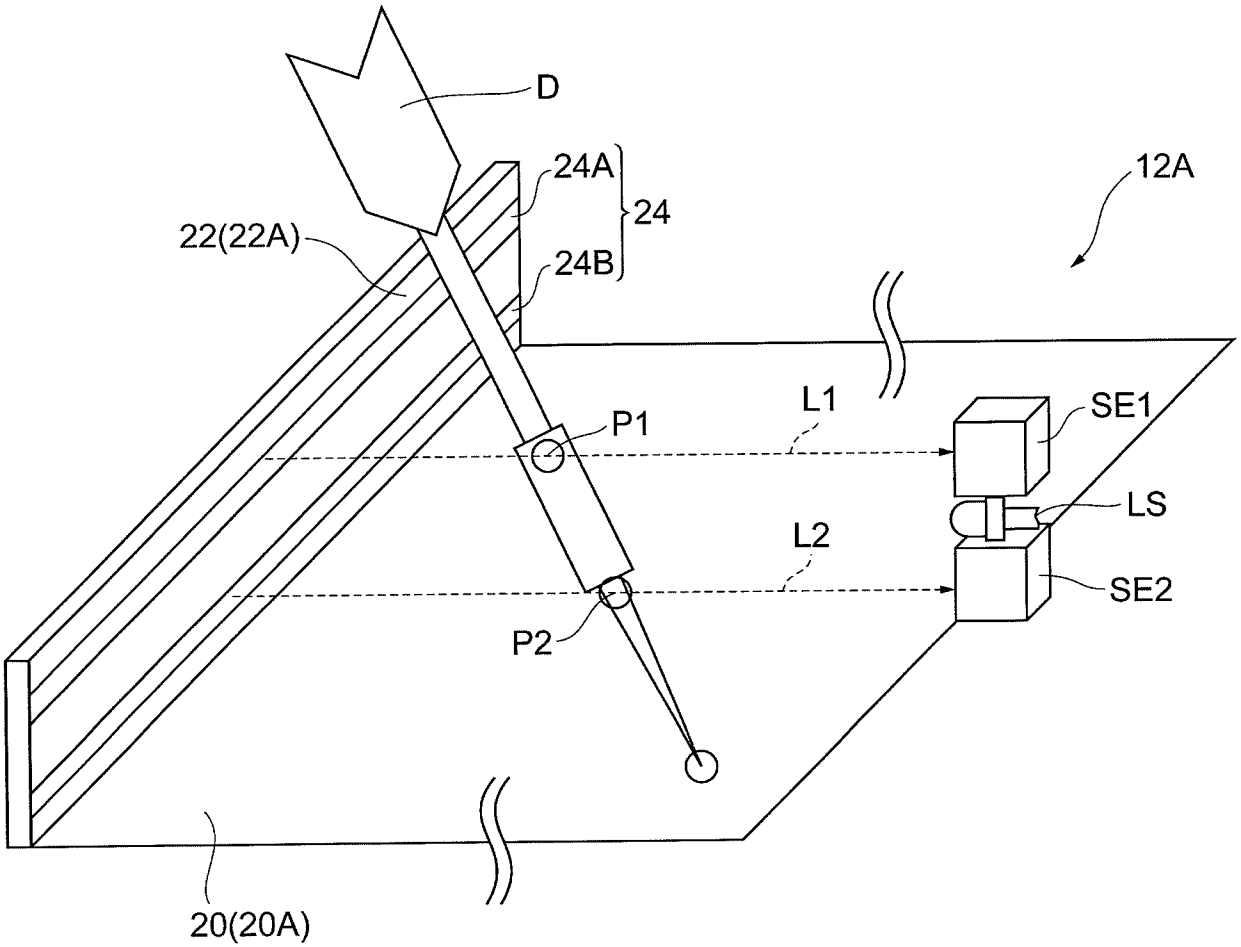
FIG. 12 is a diagram depicting a configuration of the dart board 12A illustrated in FIG. 11.

FIG. 12 is a diagram depicting a configuration of the dart board 12A illustrated in FIG. 11.

As illustrated in FIG. 12, two long and thin reflectors 24A and 24B exist on the inner wall 22A of the frame 22 in the circumferential direction of the board main body 20 of the dart board 12A. Photo-sensors SE1 and SE2 are disposed on both ends of the light sources S in the board thickness direction of the dart board 12A. In other words, two stages of the photo-sensors SE1 and SE2 are disposed in the board thickness direction. This combination of the photo-sensors SE1 and SE2 is disposed at six locations on the dart board 12A at equal intervals (not illustrated), and as a result, a total of twelve photo-sensors S are disposed two-dimensionally.

Figure 13:
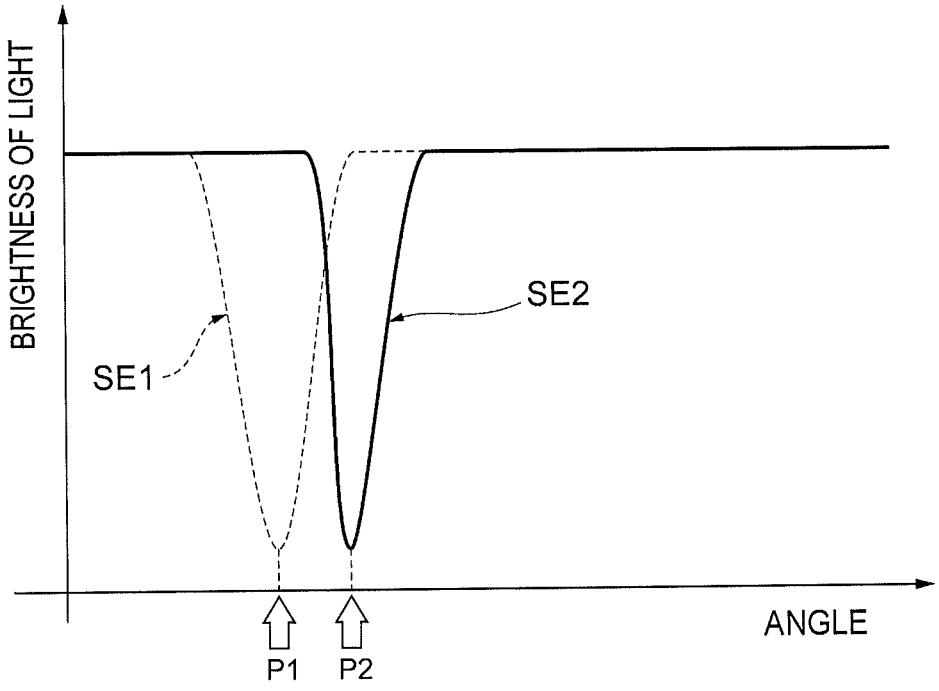
FIG. 13 is an example of a graph depicting a brightness of lights detected by the photo-sensors SE1 and SE2 according to Embodiment 2.

By this configuration, the light emitted from the light source LS is reflected back by the reflectors 24A and 24B toward the light source LS, and is separated into two lights (light along the optical axis L1 and light along the optical axis L2), and these lights pass along the board face 20A of the dart board 12A at different heights from the board face 20A of the dart board 12A in the board thickness direction. The brightness of each passed light is detected by the photo-sensors SE1 and SE2. In concrete terms, the photo-sensor SE1 detects the brightness of the light along the optical axis L1, and the photo-sensor SE2 detects the brightness of the light along the optical axis L2. Thereby as illustrated in FIG. 13, if the dart D hits the board face 20A, for example, the photo-sensors SE1 and SE2 can detect the shades of this one dart D respectively at two positions P1 and P2, where the distance (height) from the board face 20A is different.

Figure 14:
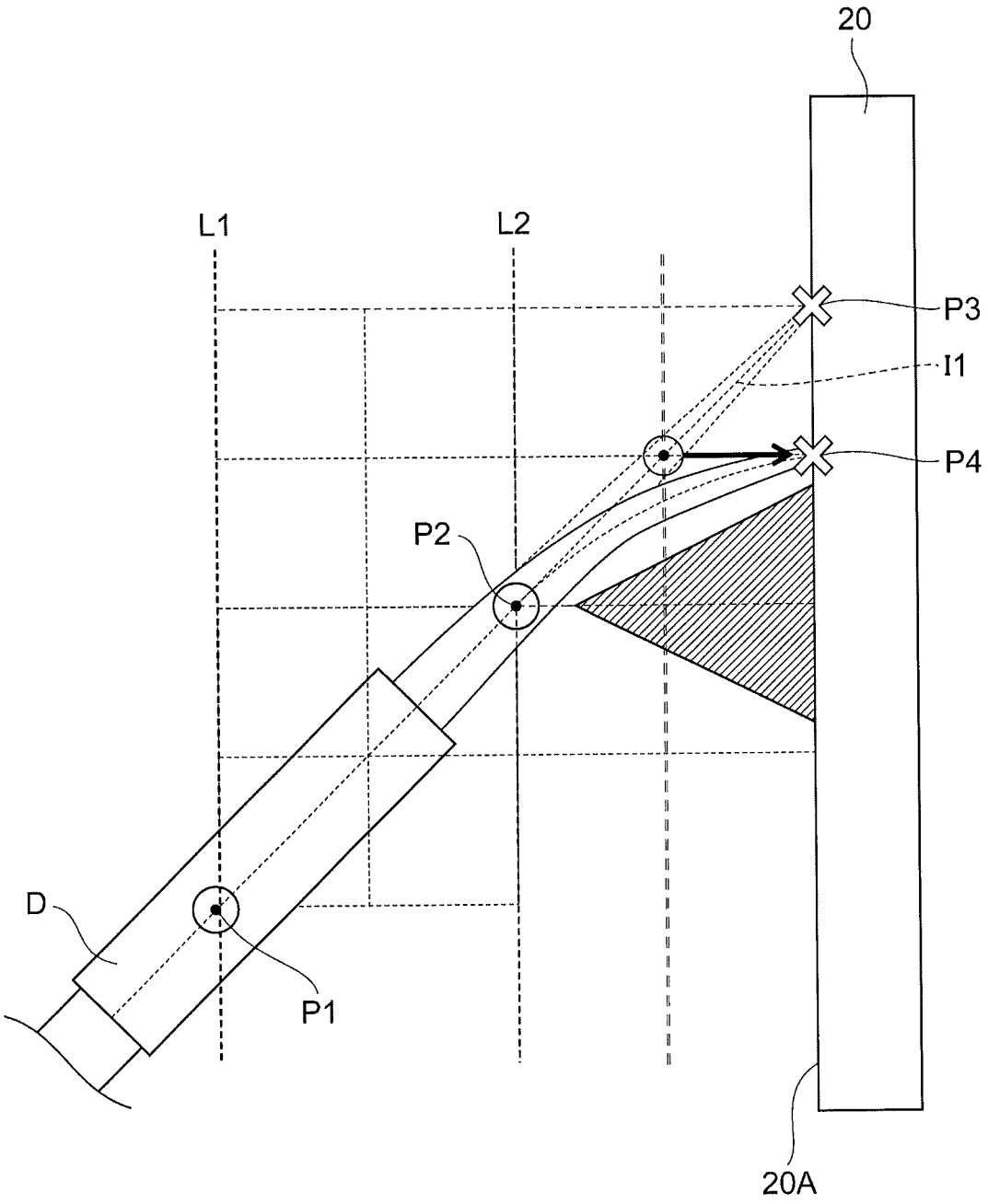
FIG. 14 is a diagram depicting calculation of the position of the dart based on the inclination of the dart.

According to Embodiment 2, when the position of the dart D is calculated in the processing in step SP24 and SP30 in FIG. 10, the CPU 41*a* acquires the angles of the shades (peaks) at the two positions P1 and P2 of the dart D, based on the brightness of the lights along the optical axes L1 and L2 respectively, which are outputted from the photo-sensors SE1 and SE2, and calculates the two positions P1 and P2 of the dart D based on these angles. Then the CPU 41*a* calculates the inclination of the dart D with respect to the dart board 12A, based on the calculated two positions P1 and P2 of the dart D. Then based on the calculated inclination, the CPU 41*a* calculates the hit position of the tip of the dart D. The method of calculating the position of the tip is not especially limited, but as shown in FIG. 14, for example, the CPU 41*a* may calculate the coordinates of an intersection P3 between a virtual line I1 based on the calculated inclination and the board face 20A, and determine the coordinates of this point as the hit position of the dart D.

However, in the case when the dart D is a soft dart of which tip portion is made of resin, this tip portion may be bent for such reasons as the impact of hitting the board face 20A, the influence of the weight of the dart, and the contact with an adjacent dart D. Hence if the coordinates of the intersection P3 between the virtual line I1 of the inclination of the dart D and the board face 20A are determined as the hit position of the dart D, an error from the actual hit position may be generated. Therefore, it is preferable that a position closer to the rear end of the dart D, compared with the position of the intersection P1 between the virtual line I1 of the inclination and the board face 20A, that is, a position closer to the optical axes L1 and L2, is determined as the hit position of the dart D. The length of the tip portion of the dart D that enters the hole is known in advance, hence the position P4 determined by subtracting the length of the tip portion from the position of the intersection P3 may be regarded as the position closer to the optical axes L1 and L2, as illustrated in FIG. 14.

The characteristic of the dart D, specifically the curvature of bending of the tip portion of the dart D, changes depending on the material, thickness, bending rigidity of the material and the like of the dart. Further, the tip portion of the dart D is often replaced by the player, so the thickness, bending rigidity of the material and the like the tip position of the dart D may vary. Therefore, the CPU 41*a* may calculate the curvature based on the average characteristic of the thickness of the tip portion of the dart, bending rigidity of the material and the like, and determine the hit position of the dart D based on the calculated curvature.

An example of an experiment to determine a hit position of the dart D will be described.

Figure 15:
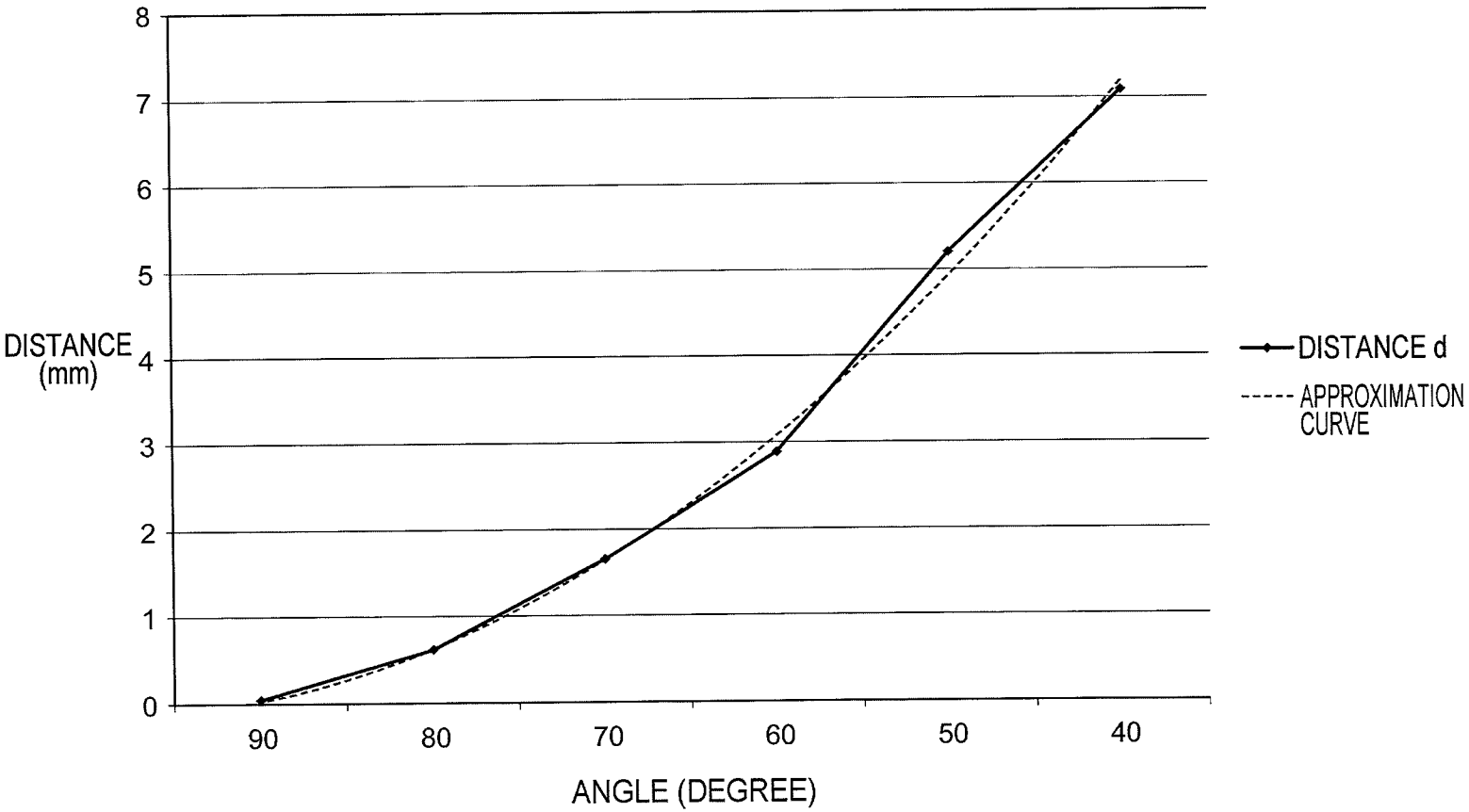
FIG. 15 is a graph depicting a relationship between the angle of the dart D and the distance d.

Using a tip portion of a standard resin dart D, the dart D hits the board face 20A at a specific location so that the dart D is inclined by 90° to 40°. A 90° inclination means that the inclination of the dart D is vertical to the board face 20A. Then the distance d between the position P4, where the dart D actually hit, and the intersection 3 (see FIG. 14) is measured. Table 1 indicates the relationship between the angle of the dart D and the distance d. FIG. 15 is a graph depicting the relationship between the angle of the dart D and the distance d.

TABLE 1

| Angle (degree) | Distance d (mm) |
|---|---|
| 90 | 0.044 |
| 80 | 0.617 |
| 70 | 1.647 |
| 60 | 2.883 |
| 50 | 5.203 |
| 40 | 7.086 |

The approximation curve indicated in FIG. 15 is a quadratic curve. As indicated in FIG. 15, the distance d, with respect to the angle of the dart D, can be approximated by a quadratic curve, where the ordinate is the distance d and the abscissa is the angle of the dart D. The distance d depends on the thickness and rigidity of the material of the tip portion of the dart D to be used, hence the quadratic curve (approximation formula) is determined in accordance with the environment in which the dart game apparatus is used. By using the determined quadratic curve, the position of the dart D can be determined.

As described above, according to Embodiment 2, the retro-reflector 24 includes two reflectors 24A and 24B, which are disposed next to each other with a space in the board thickness direction of the dart board 12, and the light emitted from the light source LS can be separated into two lights (light along the optical axis L1 and light along the optical axis L2). By using the brightness of these two lights, the shades of the dart D at positions, of which distances from the board face 20A are different, can be acquired.

Further, according to Embodiment 2, the CPU 41*a* calculates the inclination of the dart D with respect to the dart board 12 based on the brightness of the two lights, and calculates the hit position of the dart D based on the calculated inclination, hence compared with the case of not calculating the inclination, the position of the dart D can be calculated more accurately.

Furthermore, according to Embodiment 2, for the hit position of the dart D, the CPU 41*a* calculates the position P4, which is on the rear side of the dart D, compared with the position of the intersection P3 between the virtual line I1 of the dart D along the inclination of the dart D and the board face 20A of the dart board 12, hence the position of the dart D, considering the bending of the dart D, can be calculated more accurately.

Modifications

The present invention is not limited to the above embodiments. In other words, modifications of the above embodiments, which a person skilled in the art can perform by appropriately changing the design, are included in the scope of the present invention, as long as the characteristics of the present invention are included. Further, each element of the above-mentioned embodiments may be combined if technically possible, and these combinations are also included in the scope of the present invention, as long as the characteristics of the present invention are included.

Figure 16:
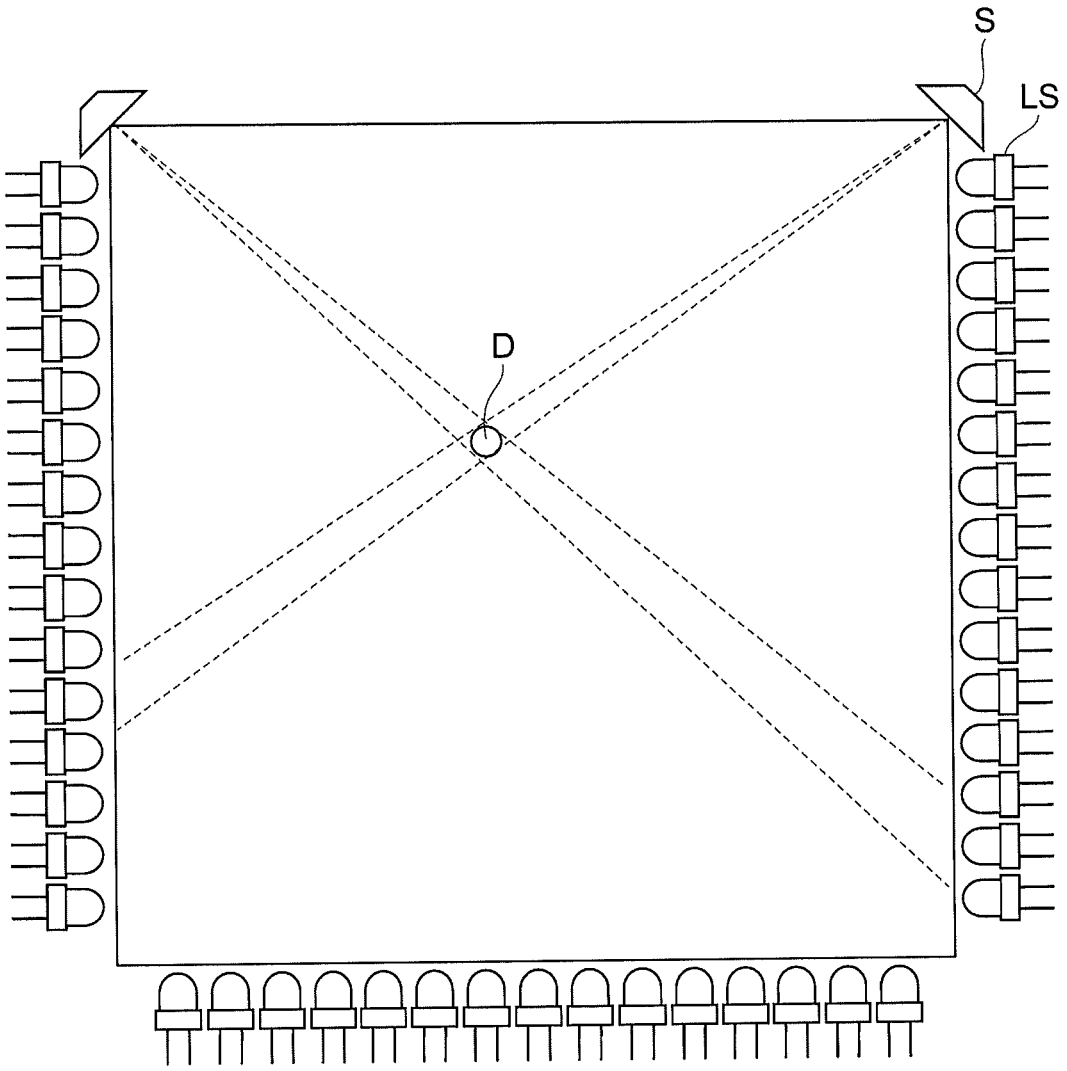
FIG. 16 is a diagram depicting a modification of the configuration of the dart board described in Embodiment 1.

For example, in Embodiment 1, a case of disposing the retro-reflector 24 was described, but the retro-reflector 24 may be omitted. In this case, the position of the dart D may be detected in the same manner as Embodiment 1 by disposing a plurality of light sources LS so as to surround the dart board 12, as illustrated in FIG. 16, for example.

Figure 17:
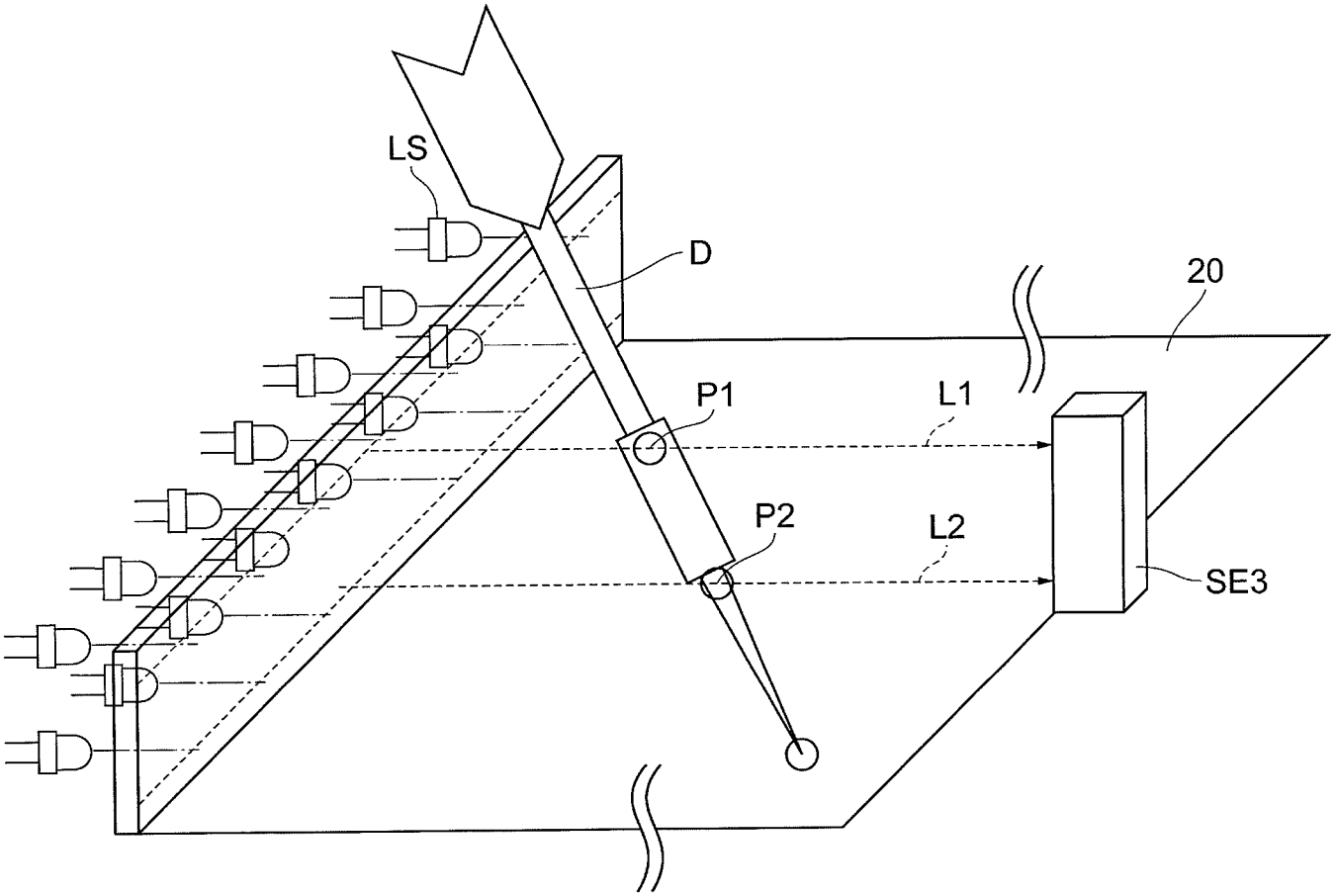
FIG. 17 is a diagram depicting a modification of the configuration of the dart board described in Embodiment 2.

In Embodiment 2, a case of disposing the two reflectors 24A and 24B, to acquire the two optical axes L1 and L2, was described, but the light sources LS which are stacked in two levels in the board thickness direction may be disposed instead, as illustrated in FIG. 17, for example.

In Embodiment 2, a case of disposing the two photo-sensors SE1 and SE2 in the board thickness direction was described, but a photo-sensor SE3, which has a width to receive the light along the optical axis L1 and the light along the optical axis L2 respectively, may be disposed instead, as illustrated in FIG. 17, for example.

In Embodiment 2, a case of the CPU 41*a* calculating the inclination of the dart D with respect to the dart board 12, based on the peaks at two locations of the dart D, was described, but the following additional processing may be added to this calculation. That is, in the case where a new dart D hits the dart board 12A and the brightness of one light detected by the photo-sensor SE1 or SE2 has a plurality of peaks (shades of the dart D), CPU 41*a* may specify the current peak of the previous dart out of the plurality of peaks, based on the peaks of the previous dart D in the past stored in the RAM 42*b*, and calculate the inclination of the dart D based on the peaks other than the specified current peak of the previous dart.

Figure 18:
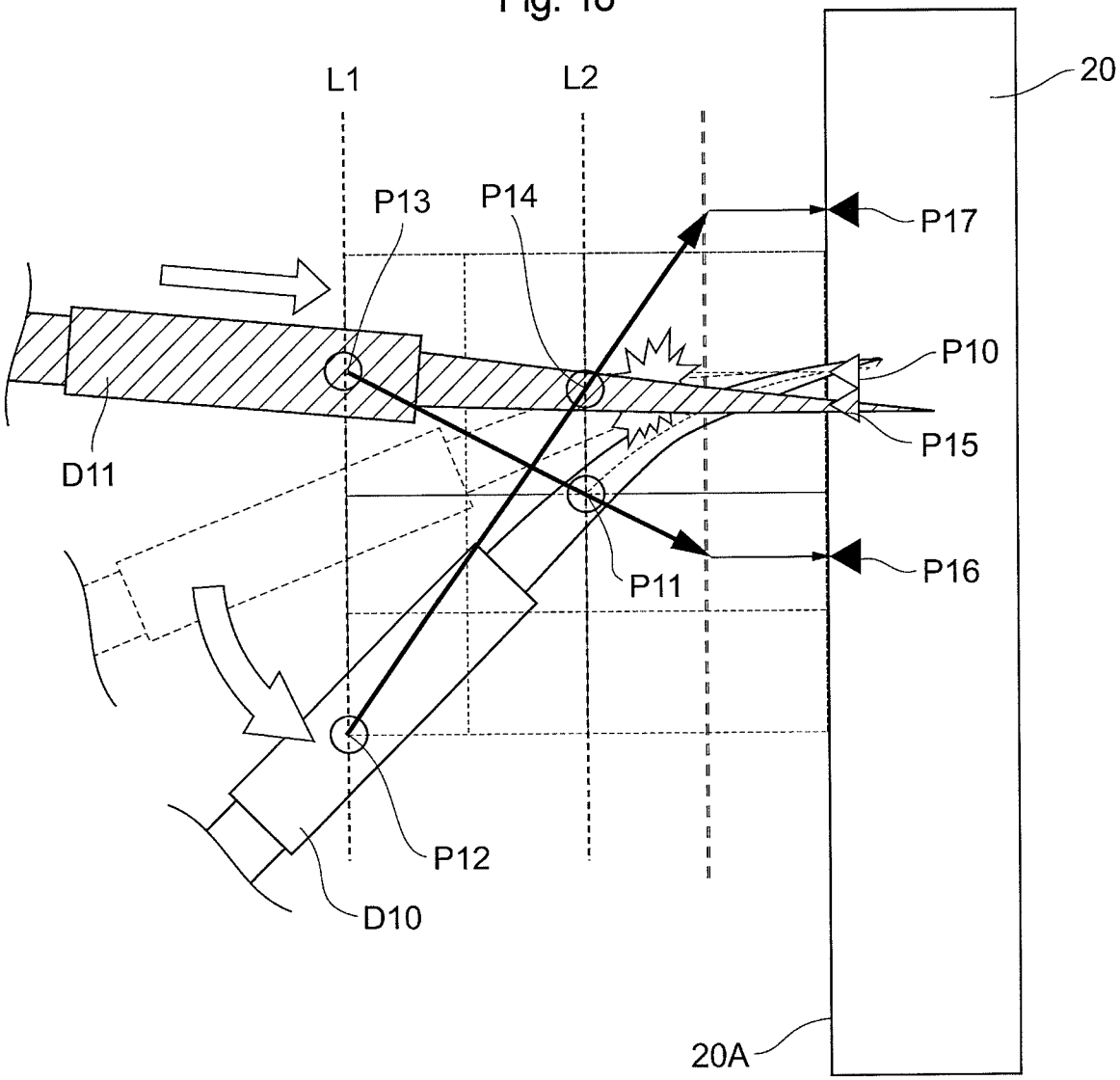
FIG. 18 is a diagram depicting the state of two darts when both hit one location.

The reason why this additional processing is added will be described. In the case where the darts D hit the same area, as illustrated in FIG. 18, the previous dart D10 and the new dart D11 may contact with each other. In such a case, the tip position P10 of the previous dart D10, which hit the wall face 20A, does not move, but the tip portion of the previous dart D10 may be bent, whereby the positions P11 and P12 on the rear end side of the previous dart D10 may move. If this occurs, a peak based on the position P12 on the rear end side of the previous dart D10 exists in the brightness of the light along the optical axis L1 detected by the photo-sensor SE1, besides the peak based on the position P13 of the new dart D11, even if the difference of the brightness from the previous time is determined. In the same manner, a peak based on the position P11 on the rear end side of the previous dart D10 exists in the brightness of the light long the optical axis L2 detected by the photo-sensor SE2, besides the peak based on the position P14 of the new dart D11, even if the difference of the brightness from the previous time is determined. In this state, if the CPU 41*a* calculates the position of the new dart D11 based on the combination of the peak at the position P13 and the peak at the position P11, or the combination of the peak at the position P12 and the peak at the position P14, then positions P16 and P17, which are different from the correct position P15, are calculated.

As a consequence, the above mentioned additional processing is added, and the CPU 41*a* specifies the peak at the position P11 and the peak at the position P12 of the previous dart D10, out of a plurality of peaks, based on the peaks of the previous dart D10 in the past, and calculates the inclination of the new dart D based on the peaks other than the specified peaks, that is, based on the peak at the position P13 and the peak at the position P14. Then the current position P15 can be calculated.

REFERENCE SIGNS LIST

10 Dart game apparatus
12, 12A Dart board
24 Retro-reflector
LS Light source
S, S1 to S10, SE1, SE2, SE3 Photo-sensor
[FIG. 3]
41 CONTROL UNIT
41*b* IMAGE PROCESSING
41*c* SOUND SIGNAL PROCESSING
42 MEMORY UNIT
43 OPERATION INPUT UNIT
43*a* OPERATION PANEL
[FIG. 9]
BRIGHTNESS OF LIGHT
ANGLE
[FIG. 10]
START
SP10 REPEAT FOR A NUMBER OF PLAYERS
SP12 REPEAT FOR n NUMBER OF DARTS
SP14 CHANGE BUTTON PRESSED?
SP16 ACQUIRE BRIGHTNESS OF EACH LIGHT
SP18 DART IS THROWN?
SP20 FIRST THROW?
SP22 STORE BRIGHTNESS OF LIGHT
SP24 CALCULATE POSITION OF DART BASED ON BRIGHTNESS OF LIGHT
SP26 CALCULATE DIFFERENCE OF BRIGHTNESS OF LIGHT THIS TIME AND
BRIGHTNESS OF LIGHT LAST TIME
SP28 STORE EACH DIFFERENCE
SP30 CALCULATE POSITION OF DART BASED ON EACH DIFFERENCE
SP32 CALCULATE SCORE AND PERFORMANCE
SP38 DETERMINE WIN OR LOSE AND PERFORMANCE
END
[FIG. 13]
BRIGHTNESS OF LIGHT
ANGLE
[FIG. 15]
DISTANCE (mm)
ANGLE (DEGREE)
DISTANCE d
APPROXIMATION CURVE

What is claimed is:

1. A dart game apparatus that provides a dart game in which one player successively throws n number of (n=3 or 4) darts at a dart board, the apparatus comprising:

light sources that are disposed around the dart board and emit lights along a board face of the dart board, wherein the dart board has a board thickness in a board thickness direction, and wherein the board thickness direction is perpendicular to the board face;

a plurality of photo-sensors that are disposed around the dart board at approximately the same height from the dart board in the board thickness direction, and detect brightness of lights emitted from the light sources;

a processor that calculates a hit position of a dart on the dart board based on the brightness of the lights detected by the plurality of photo-sensors; and a retro-reflector disposed around the dart board, wherein the retro-reflector includes two reflectors, wherein the reflectors are parallel to each other, wherein the reflectors are spaced apart from each other in the board thickness direction, and wherein the reflectors extend in a circumferential direction of the dart board, and wherein a number of photo-sensors is n×2, wherein the photo-sensors detect the brightness of the lights along a plurality of optical axes which pass from the dart board at different heights in the board thickness direction, and the processor calculates the inclination of the dart with respect to the dart board based on the brightness of the lights along the plurality of optical axes respectively, and calculates the hit position of the dart based on the calculated inclination, and wherein in the case where a new dart hits the dart board successively from a previous dart, and a photo-sensor detects a plurality of the brightnesses of lights based on the previous dart and the new dart in one optical axis, the processor specifies a brightness of a current light of the previous dart after the new dart hits the dart board from the plurality of the brightnesses of lights, based on a past brightness of the previous dart before the new dart hits the dart board, and calculates an inclination of the new dart based on a brightness of light other than the specified brightness of the current light of the previous dart.

2. The dart game apparatus according to claim 1, wherein in the case where a dart hits the dart board, the processor stores the brightness of lights detected by the photo-sensors, and in the case where the next dart hits the dart board, the processor calculates the difference between the brightness of light detected by the photo-sensor and the stored brightness of light, and calculates the hit position of the next dart based on the difference.

3. The dart game apparatus according to claim 1, wherein for the hit position of the dart, the processor calculates a position by subtracting a predetermined length from the position of an intersection between a virtual line based on the inclination and the dart board.

4. The dart game apparatus according to claim 3, wherein the processor determines the predetermined length based on characteristics of a tip portion.

* * * * *